US005645460A

United States Patent [19]

Johnson

[11] Patent Number: 5,645,460

[45] Date of Patent: Jul. 8, 1997

[54] RETRACTABLE FIN ASSEMBLY

[76] Inventor: Carroll L. Johnson, 2658 Paradise Way, Grand Junction, Colo. 81506

[21] Appl. No.: 553,770

[22] Filed: Oct. 23, 1995

Related U.S. Application Data

[63] Continuation-in-part of Ser. No. 200,751, Feb. 23, 1994, Pat. No. 5,531,621.

[51] Int. Cl.[6] ..... A63B 31/11

[52] U.S. Cl. ..... 441/61; 441/63

[58] Field of Search ..... 441/60–64, 77; 440/21

[56] References Cited

U.S. PATENT DOCUMENTS

| | | | |
|---|---|---|---|
| 2,343,965 | 3/1944 | Fisch | 441/61 |
| 3,081,467 | 3/1963 | Ciccotelli | 441/63 |
| 3,084,355 | 4/1963 | Ciccotelli | 441/61 |
| 3,268,927 | 8/1966 | Markowitz | 441/63 |

*Primary Examiner*—Sherman Basinger

*Attorney, Agent, or Firm*—John L. Isaac

[57] ABSTRACT

A retractable fin assembly is disclosed for attachment to the boot of a float tube user. The assembly includes a fin member movable between a fast position projecting below the boot adapted for propelling the float tube user forwardly in the water and a second position adapted for retraction relative to the heel of the boot to permit walking on land by the float tube user. Propulsion vanes are carried by the fin member and have a closed position for providing substantial resistance to the flow of water as the fin member is moved in rearward direction relative to the user. The vanes also have an open position for providing substantially reduced resistance to the flow of water as the fin member is moved in forward direction relative to the user. Finally, a mechanism is provided for attaching the fin member to the boot of a user so that the fin member first position aligns the propulsion vanes at a pre-selected angle of approximately 90° or more between the propulsion vanes and a horizontal plane defined by the boot sole as the fin member projects downwardly from and behind the heel of the boot, and the second position aligns the fin member behind the heel and the leg of the user above the horizontal plane defined by the boot sole.

23 Claims, 14 Drawing Sheets

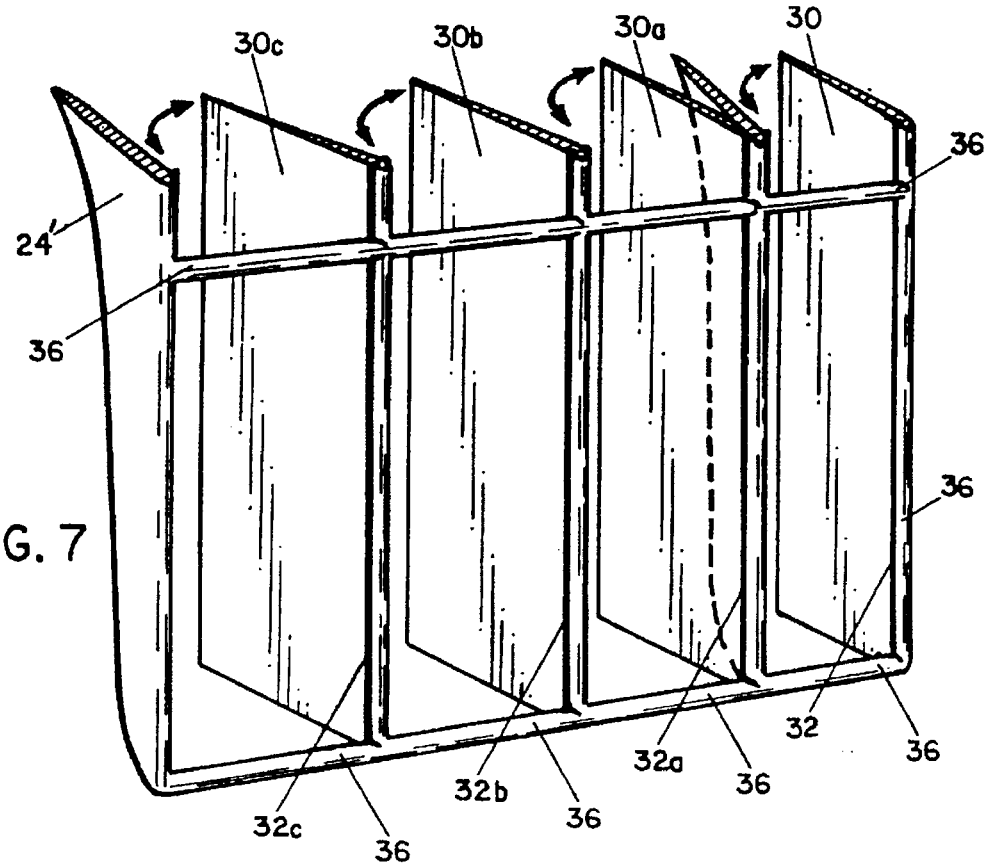
FIG. 7
FIG. 7A
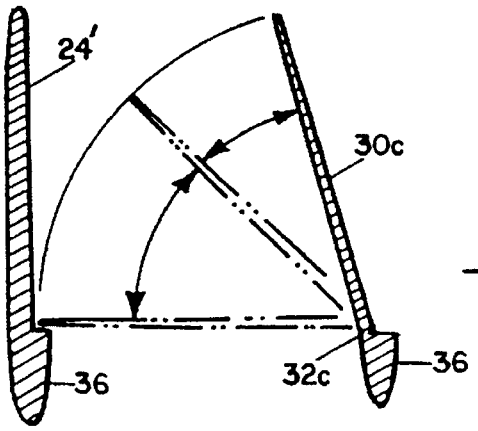
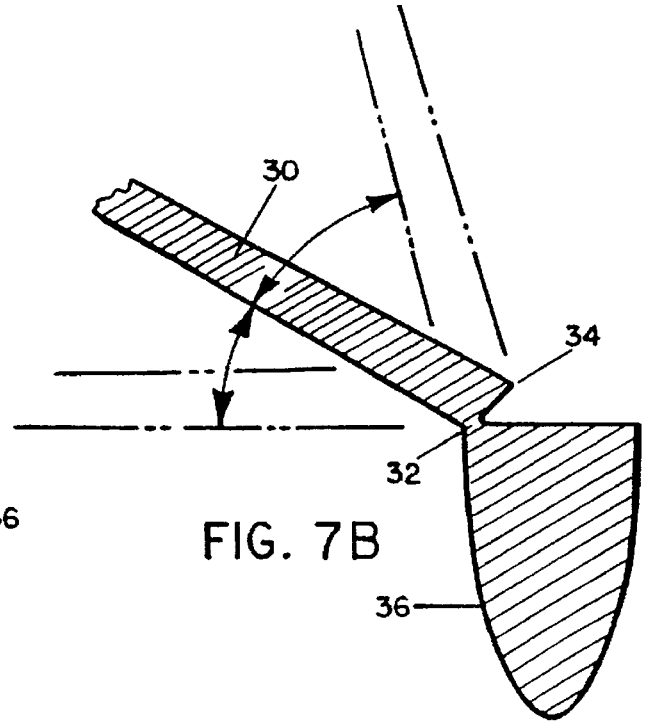
FIG. 7B

FIG. 8
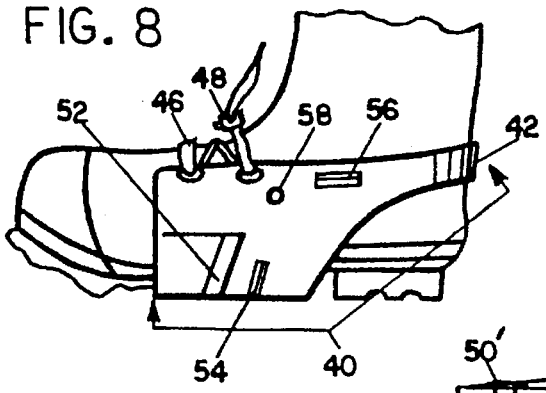
FIG. 8A
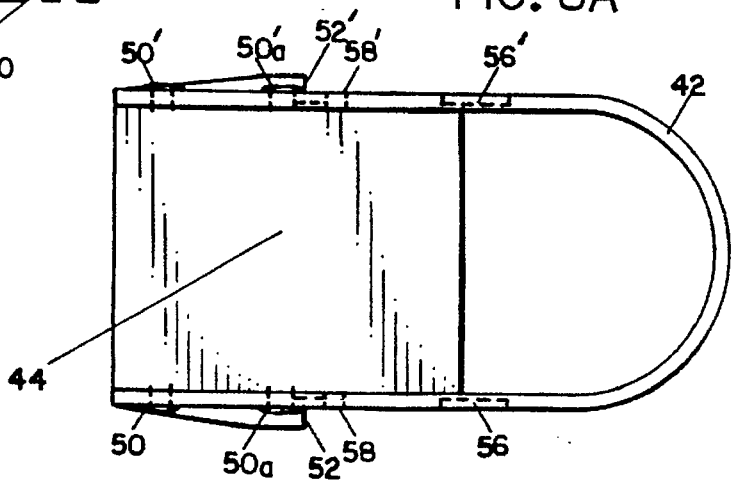
FIG. 8B
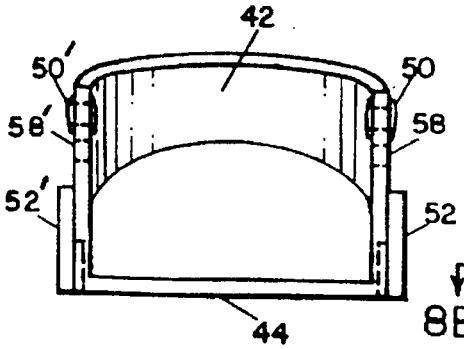
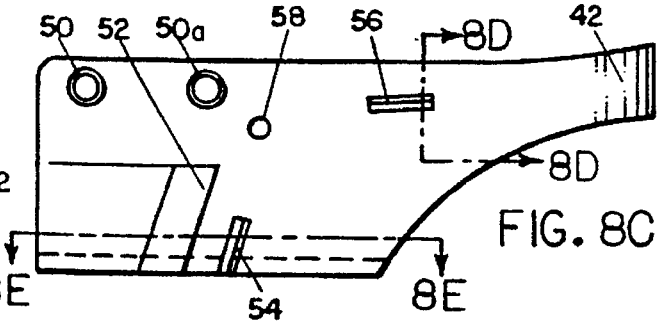
FIG. 8C
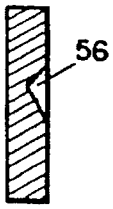
FIG. 8D
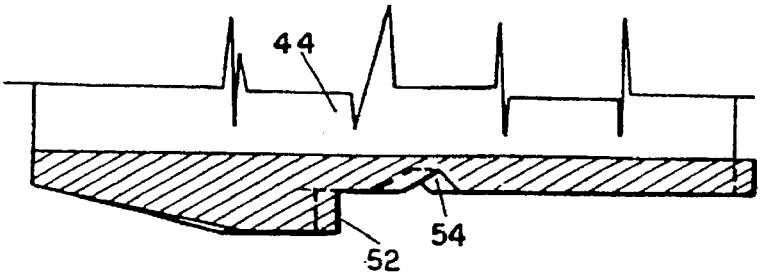
FIG. 8E

RETRACTABLE FIN ASSEMBLY

RELATED APPLICATION

This application is a Continuation-In-Part of U.S. patent application Ser. No. 08/200,751, which was filed on Feb. 23, 1994 and issued on Jul. 2, 1996 as U.S. Pat. No. 5,531,621.

BACKGROUND OF THE INVENTION

1. Field of the Invention

This invention relates generally to an improved propulsion mechanism for use with float tubes commonly used in fishing and, more particularly, to an improved foot fin assembly for propelling the user of such a float tube. Specifically, the present invention relates to an improved foot fin assembly for use in propelling the user of a float tube in a forwardly facing direction while simultaneously permitting the user of such foot fins to walk on land without removing the fin assembly.

2. Description of the Prior Art

In general, users of float tubes for fishing incorporate some type of propulsion devices on their feet in order to assist in moving about the water's surface. Most float tube fins are similar in design to the foot fins used by swimmers and divers. Illustrations of such devices include those shown in U.S. Pat. Nos. 3,183,529, 3,268,927, 4,857,024, 4,889,510, 4,929,206, 4,940,437 and 5,108,327 as well as German Patent No. 4020235. Such devices operate by movement of the user's legs and feet in a flutter kick which propels the swimmer or diver in a forward direction. However, when they are utilized by the user of a float tube, they propel the float tube user rearwardly or backwardly relative to the direction the user is facing. This direction is generally opposite the direction the float tube user normally wishes to move when pursuing rising fish or in moving to another spot located in front of him. Moreover, the efficiency of such prior art fins is low so that the use of such devices in traveling any type of a distance when using a float tube is very strenuous and tiring.

In addition, these types of fins generally limit normal walking foot movement due to their forward extension portions which create a risk of falling while walking with the fins on. Walking in marginal water to enter or exit a body of water is particularly hazardous, for in addition to the clumsiness of the protruding fins and the restriction of movement and visibility caused by the float tubes, the walker has to overcome the water's resistance on the fins with each step. As a consequence, most users of forward extending fins walk backwards to enter and exit the water, and such backward walking with a bulky float tube in place creates a significant danger of falling and injury to the user.

The process of donning and removing a ring-shaped float tube while wearing such forwardly extending prior art fins is also difficult and hazardous. For example, the bulk and shape of an annular float tube limits movement, necessitating that the fins be attached to the user's feet prior to donning the float tube. In such an instance, with the float tube lying flat on the ground and the fins attached to the user's feet, the user then balances on one foot while stepping over the circumference of the tube with the other foot and inserting the other foot with fin into the leg opening of a float tube seat. Thus straddling the tube, the user then shifts his or her balance to the foot now inside the tube so as to lift the opposite foot with fin over the tube and insert it also into the leg opening of the seat. At this particular point, balancing is especially difficult presenting a danger of falling. The forward extension of such prior art fins, their general configuration and size, and the constriction of the seat of an annular float tube makes it extremely awkward to insert both feet with fins in place into the leg opening of a float tube. Balancing is especially difficult while bending over to maneuver the unwieldy tube into position to facilitate inserting the fin of the second foot into the leg opening.

As the result of such difficulties, several fins have been designed to provide means of forward propulsion by float tube users. Moreover, designs have been provided wherein a single paddle is secured to an existing shoe of a float tube user. Such designs include U.S. Pat. Nos. 1,983,609, 2,395,844 and 4,664,639. Moreover, an unpatented device known as the Paddle Pusher by Fishmaster Manufacturing Co. of Oklahoma City, Okla., provides side paddles to be worn on existing tennis shoes. The design of these type of fins compel the float tube user to assume a forced, unnatural position in the float tube. Moreover, these designs are generally inefficient in use relative to a full leg movement of the user of a float tube. For example, the design and construction of a float tube seat generally places a user thereof in the posture of a person typically seated in a chair with their legs and feet extended generally outwardly and forwardly. Use of the fin disclosed in U.S. Pat. No. 4,664,639 requires the user to lean forward against the designed posture of the float tube in order to position their legs in a vertical plane and make use of the device of this particular patent. The paddle pusher device also compels the user of a float tube to assume a forced, upright position to move through the water. As a consequence, much of the user's leg motion with these devices is wasted, and such awkward movement within the float tube is inherently dangerous.

U.S. Pat. No. 805,525 and U.S. Pat. No. 3,081,467 both disclose devices for attachment to the leg of a user to assist in swimming, which devices include plural flaps to assist in propulsion by providing resistance against water movement in one direction. The device illustrated in U.S. Pat. No. 805,525 requires specific movement of the user to open and close the flaps. The device illustrated in U.S. Pat No. 3,081,467 is adapted to be oriented in a vertically downward position from the toe of a swim flipper for operation and in a vertically upward position in order to permit walking by a swimmer. However, given the nature of a swim flipper, forward walking is very difficult as previously mentioned. Moreover, this device is designed to slip over the foot similar to a swim flipper and designed to help push water away from the foot as the user's leg is extended outwardly thereby pushing the user of a float tube rearwardly as with many prior art devices.

The device of the above related U.S. Pat. No. 5,531,621, the contents of which are specifically incorporated herein by reference, overcomes many of the objections to the prior art devices described above. However, the hinging arrangement of this related invention can sometimes be awkward when moving it from its closed to its operative position. The present invention, however, overcomes all of the aforementioned difficulties of the prior art devices and also improves the ease by which a user of the device can move the device from its retracted position for walking to its operative position for paddling. Moreover, the present invention has the capability for varying the angle of orientation of the device in its operative position to increase efficiency depending upon the orientation and size of the user of a float tube.

SUMMARY OF THE INVENTION

Accordingly, it is one object of the present invention to provide an improved float tube fin for enabling forward propulsion in the direction which the user faces.

It is another object of the present invention to provide a fin assembly which is retractable to permit the user to walk in a normal manner without removal of the fin assembly from the feet of the user.

Yet another object of the present invention is to provide a retractable fin assembly for use by a user of a float tube which is more efficient and utilizes less energy for movement.

A further object of the present invention is to provide a retractable fin assembly for attachment to the boot of a float tuber user which is designed for greater case of operation and movement between its extended operational position and its retracted position.

Still another object of the present invention is to provide a retractable fin assembly for a float tube user which is positioned below the user's foot when in operation close to the vertical center line of the user's body, and eliminates side-to-side yawing and wasted energy.

To achieve the foregoing and other objects and in accordance with the purpose of the present invention, as embodied and broadly described herein, a retractable fin assembly is disclosed for attachment to the boot of a float tube user. The assembly includes a fin member movable between a first position projecting below the boot adapted for propelling the float tube user forwardly in the water and a second position adapted for retraction relative to the heel of the boot to permit walking on land by the float tube user. Propulsion vanes are carried by the fin member and have a closed position for providing substantial resistance to the flow of water as the fin member is moved in rearward direction relative to the user. The vanes also have an open position for providing substantially reduced resistance to the flow of water as the fin member is moved in a forward direction relative to the user. Finally, a mechanism is provided for attaching the fin member to the boot of a user so that the fin member's operational position aligns the propulsion vanes at a pre-selected angle of approximately 90° or greater between the propulsion vanes and a horizontal plane defined by the boot sole as the fin member projects downwardly from and behind the heel of the boot, and its retracted position aligns the fin member behind the heel and the leg of the user above the horizontal plane defined by the boot sole.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings:

FIG. 7 is a front perspective view of the embodiment illustrated in FIG. 6C;

FIG. 7A is an enlarged schematic sectional view of the fin extension arm and one propulsion vane from the end of FIG. 7;

FIG. 7B is yet a further enlarged cross-sectional view of a single propulsion vane with details of the propulsion vane hinge;

FIG. 8 is a side schematic illustrating a foot-attachment member of the fin assembly of the first embodiment in position on the foot of a user;

FIG. 8A is top plan view of the foot-attachment member of FIG. 8 without the boot of the user;

FIG. 8B is front view of the foot-attachment member as illustrated in FIG. 8A;

FIG. 8C is a side view of the foot-attachment member illustrated in FIG. 8A without the boot of the user;

FIG. 8D is cross-sectional view taken substantially along the line 8D—8D of FIG. 8C;

FIG. 8E is a cross-sectional view of the foot-attachment member of the first embodiment taken substantially along line 8E—8E of FIG. 8C;

DETAILED DESCRIPTION OF THE PREFERRED EMBODIMENT

Figure 1:
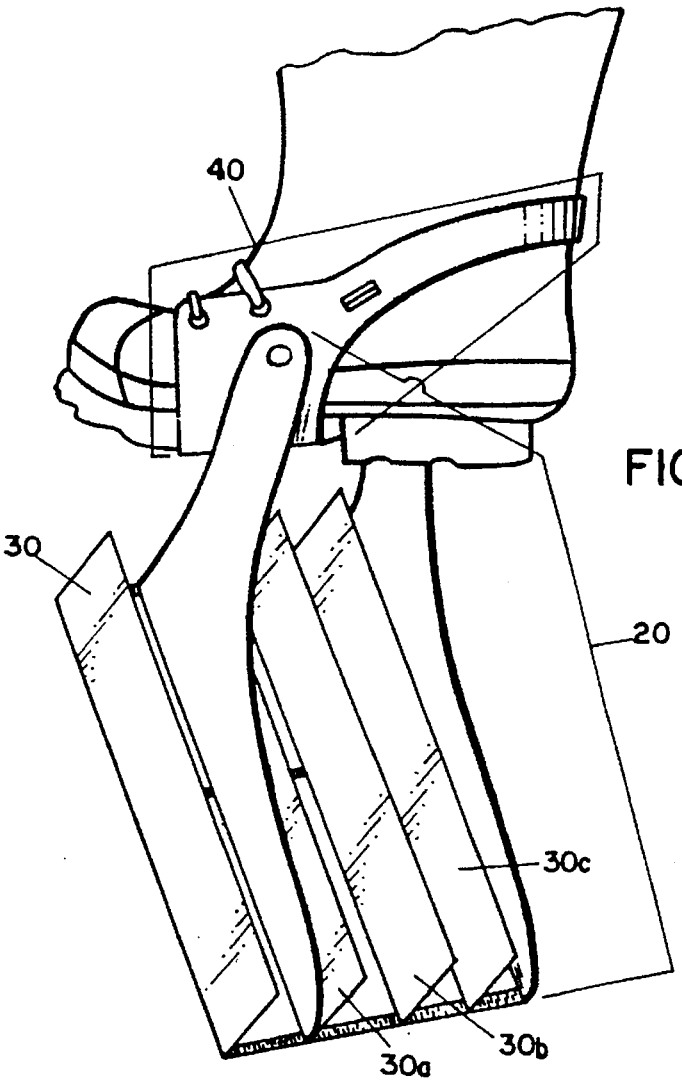
FIG. 1 is a side perspective view illustrating a hinged fin assembly constructed in accordance with the first embodiment of the present invention when the fin assembly is in its extended position for use in the water.
Figure 2:
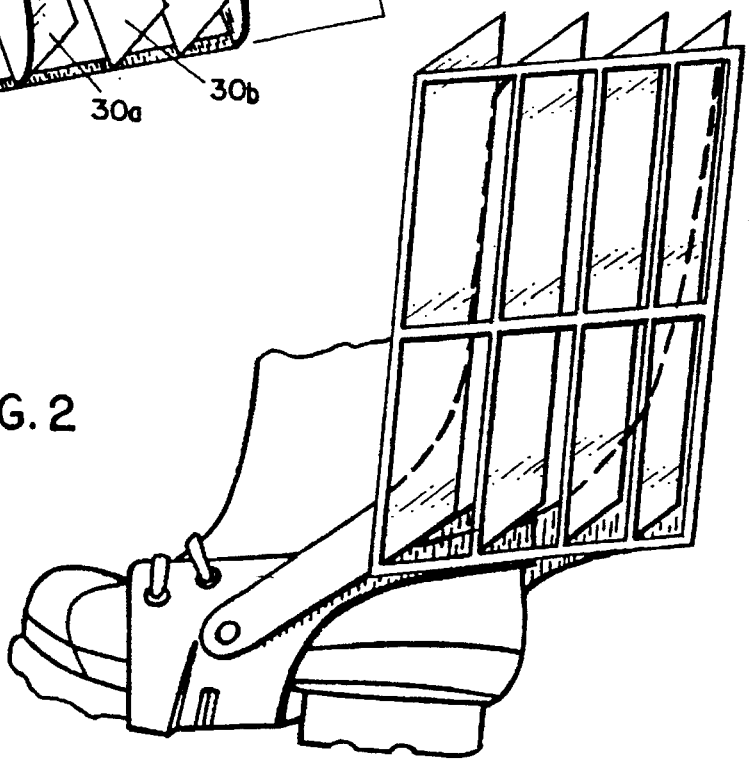
FIG. 2 a side perspective view similar to FIG. 1 but illustrating the hinged fin assembly in a retracted position for walking.

Referring first to FIGS. 1–8E which illustrate the hinged embodiment of the fin assembly of the present invention as originally described and claimed in the referenced parent application, FIG. 1 shows a complete foot fin, viewed from the rear and outside of the wearer's left foot. The fight fin is similar, but opposite. This view shows a float tube user's retractable hinged foot fin including in combination, a foot-attachment member 40 as a pivotal means of attaching a fin assembly 20 to a user's foot, such that fin assembly 20 can be aligned relative to the user's foot in a plurality of positions for use in propelling a float tube in the water as well as for walking in marginal water and on land. Fin assembly 20 is shown in the extended position for use in the water. Propulsion vanes 30 are formed integral with fin assembly 20 to be positioned at rest in a partially open position as shown in FIG. 1. FIG. 2 illustrates the fin assembly 20 in its retracted position essentially in a vertical plane parallel and adjacent to the user's calf. In this position the fin assembly 20 is clear of contact with the earth so that it does not interfere with walking or other movement.

Figure 3:
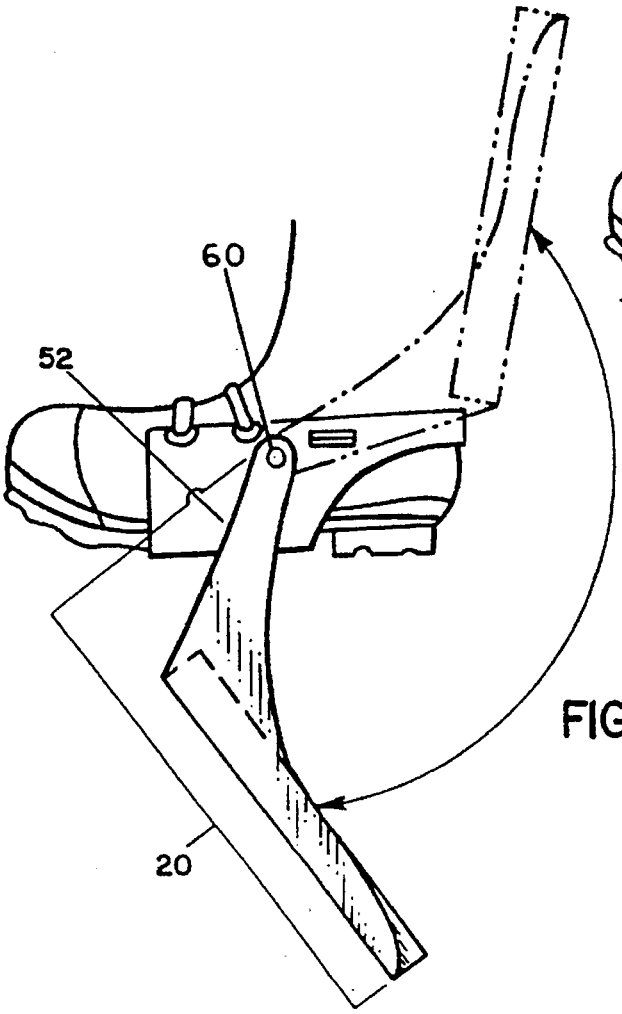
FIG. 3 is a side schematic illustrating the fin assembly of this first embodiment pivoting between extended and retracted positions.
Figure 4:
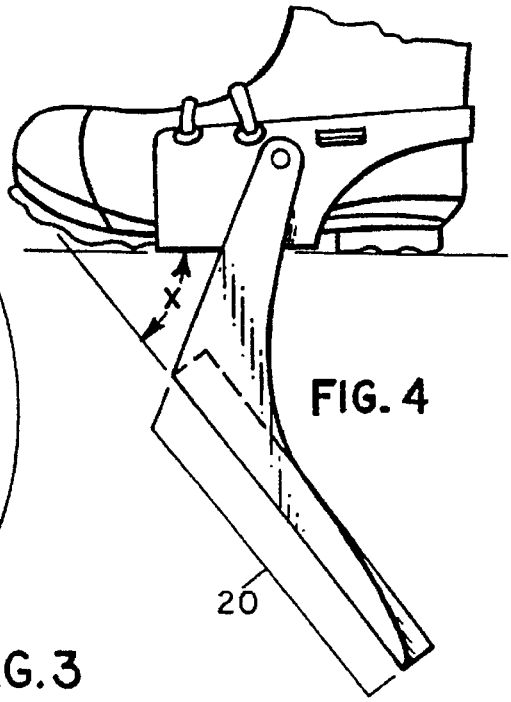
FIG. 4 is a side schematic similar to FIG. 3 and illustrating the angle of the fin assembly of the first embodiment to the sole of a user's foot.
Figure 5:
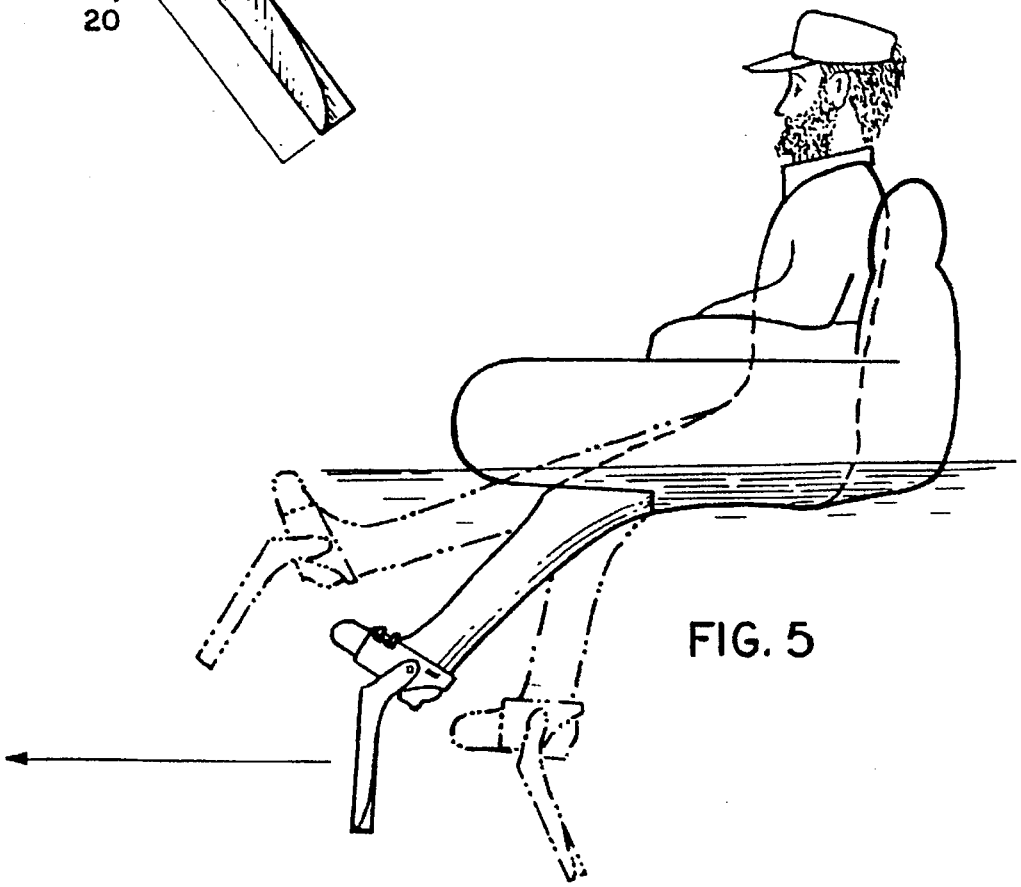
FIG. 5 is a schematic illustrating the first embodiment of the fin assembly of the present invention secured to the foot of a user seated in a float tube and illustrating the approximate range of leg motion.

Referring now to FIGS. 3–5 the sweep or range of the fin assembly 20 moving about a pivot rivet 60 is illustrated between the extended and retracted positions. The fin assembly 20 is held at a predetermined position relative to the user's foot by a fin extension arm stop 52 and a spring releasable latching mechanism shown and described in greater detail in FIGS. 8, 8A, 8B, 8C, 8D, and 8E. FIG. 4 illustrates the predetermined angular positioning that is the angle X, of the fin assembly 20 relative to the sole of the user's foot when the fin assembly 20 is in its extended operational position. This orientation places the fin assembly 20 at the mean optimum angle of attack to develop maximum thrust as the user's legs are moved to propel the float tube. This will be more clearly understood from consideration of the illustration of normal leg movement of a float tube user as shown in FIG. 5. While the angle X may be adjusted as desired, the mean optimum angle is preferably approximately 55° to 75°.

FIG. 5 illustrates the normal posture and approximate range of leg and foot motion of a person seated in a typical float tube in the water. Generally, the design and construction of the seat of a float tube places a user in a posture similar to that of a person seated in a chair, with his or her legs and feet extended outwardly in front. The limited range of leg movement and posture of the user are factors in determining the preferred angle X of fin assembly 20 as discussed in the description of FIG. 4 above. In this orientation, the plane defined by the propulsion vanes 30 when in a closed position against the frame 36 is substantially perpendicular to its general direction of movement through the water.

Figure 6:
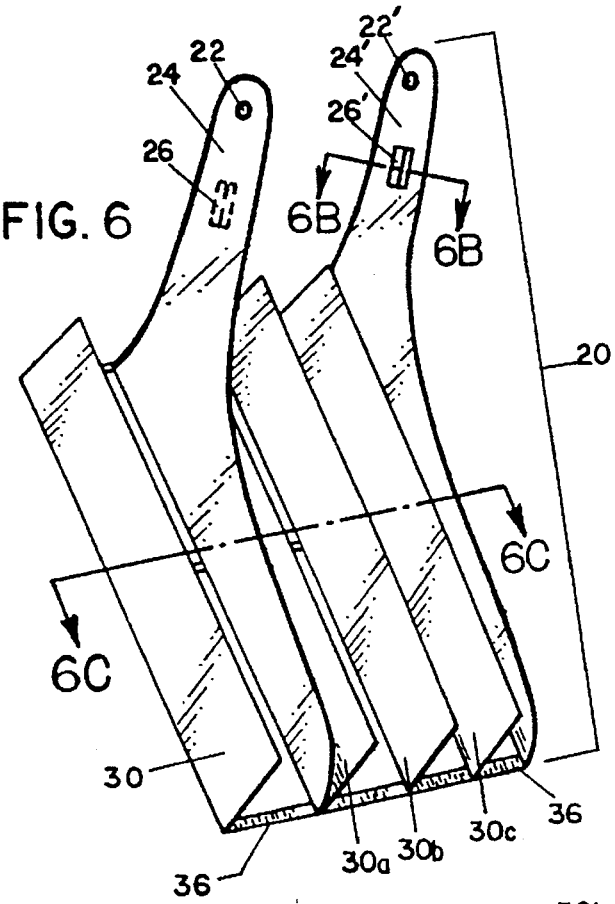
FIG. 6 is a rear perspective view illustrating the complete fin assembly of the first embodiment of the present invention removed from the foot attachment member to illustrate details of construction.

FIG. 6 shows the fin assembly 20 removed from the foot-attachment member 40 to illustrate particular construction details. The fin assembly 20 is viewed from the same position as in FIG. 1. The hinged fin assembly 20 preferably includes fin extension arms 24, the propulsion vane frame 36, propulsion vane hinges 32, which are illustrated in greater detail in FIG. 7B, and the propulsion vanes 30. The fin extension arms 24 are fastened to foot-attachment member 40 preferably by pivot rivets 60, as indicated in FIG. 3, passing through the fin pivot holes 22. Fin assembly 20 is preferably retained in the extended and retracted positions by latch dogs 26 formed integral with the fin extension arms 24. The latch dogs 26 fit into detents 54 and 56 formed in the foot-attachment member 40 as shown in FIGS. 8C, 8D, and 8E.

Figure 6A:
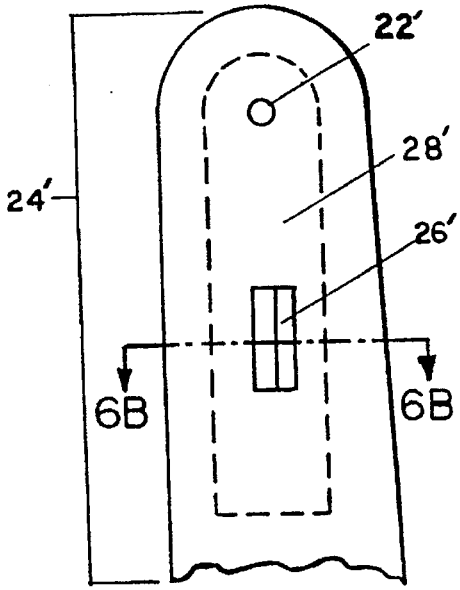
FIG. 6A is an enlarged, partial side view of the fin extension arm of the embodiment illustrated in FIG. 6.
Figure 6B:
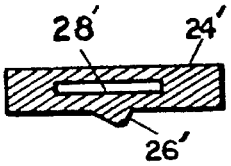
FIG. 6B is a cross-sectional view taken substantially along line 6B—6B of FIG. 6A and illustrating details of the latch dog and latch spring of the first embodiment of the present invention.

FIGS. 6A and 6B are enlarged drawings of the upper portion of the inside fin extension arm 24' shown in FIG. 6. FIG. 6B is a cross-sectional view showing the latch dog 26' in more detail, and a flat latch spring 28' formed integral within fin extension arm 24'. Latch spring 28' exerts pressure against the latch dog 26' to retain the latch dog 26' in the appropriate detent, as shown in FIGS. 8C, 8D, and 8E, when the fin assembly 20 is in either the extended or the retracted position. Both extension arms 24, 24' of each fin are similar, but opposite.

Figure 6C:
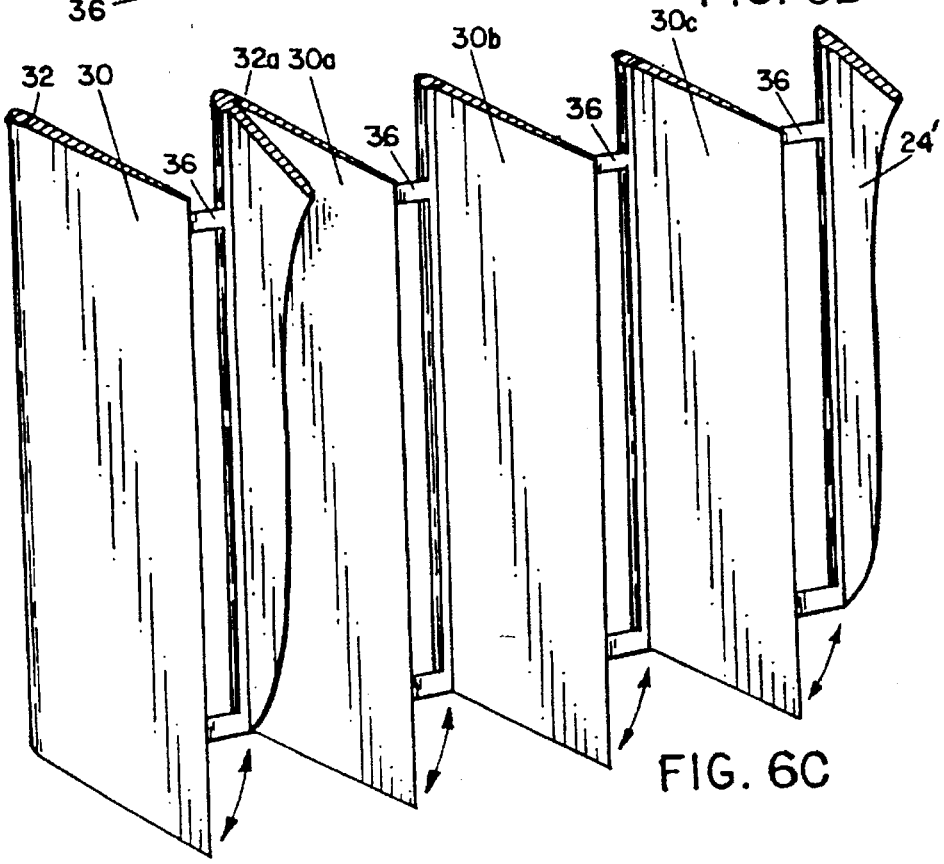
FIG. 6C is an enlarged perspective sectional view of the lower portion of the fin assembly embodiment taken substantially along line 6C—6C of FIG. 6 and illustrating cross-sectional details of the hinged propulsion vanes of the present invention.

FIG. 6C illustrates a section of the lower portion of the hinged fin assembly 20. The drawing shows cross-sectional details of the fin extension arms 24, 24', the propulsion vane frame 36, the propulsion vane hinges 32 and the propulsion vanes 30. Arrows at the bottom of the illustration of FIG. 6C indicate the directions of rotation of the propulsion vanes 30 between the open and closed positions. The propulsion vanes 30 function in combination within the fin assembly 20 as a flow controlling device to cause the fin assembly 20 to have a directionally differential resistance to movement through the water as a means of propelling a float tube forward in the water by movement of the user's legs in a forward and backward striding motion.

FIG. 7 is the same section of the hinged fin assembly 20 shown in FIG. 6C only viewed from the opposite side, showing the leading or forward side of the frame 36 as the user faces, with the fin in the extended position. The illustration of FIG. 7 shows the fin extension arms 24, 24' formed integral with the propulsion vane frame 36. The propulsion vanes 30 are preferably attached by propulsion vane hinges 32 formed integral with the propulsion vane frame 36, which is shown in greater detail in FIGS. 7A and 7B. FIG. 7A shows an enlarged view of the fin extension arm 24' and one propulsion vane 30c from the side of FIG. 7. Rotation of propulsion vane **30*c*** is shown in moving between the full open and closed positions.

FIG. 7B illustrates a more greatly enlarged cross-sectional view of one of the propulsion vanes 30 showing details of the live propulsion vane hinge 32, also known as a "living hinge" formed integral with the propulsion vane 30 and the propulsion vane frame 36. The hinge 32 is formed to preferably position the vane 30 in a medial position minimizing the amount of movement to either the fully closed or open position. In its most fully open position, the propulsion vane 30 is retained in a slightly less than full open position by a propulsion vane stop 34 formed as part of the propulsion vane 30. When the user's leg is moved toward the rear, pressure against the water causes the slightly less than full open vane 30 to pivot at its hinge to its fully closed position, stopped by the propulsion vane flame 36 as more particularly shown in FIG. 7A. In the fully closed position, the propulsion vanes 30 incur maximum resistance to movement through the water, thereby creating a forward thrust.

Referring now to FIGS. 8, 8A, 8B, and 8C, a foot-attachment member 40 is illustrated with a fin assembly 20 removed to show construction details. Foot-attachment member 40 is secured to the user's foot in one embodiment by a foot-attachment heel strap 42, a foot-attachment sole 44 and a foot-attachment lacing 46. The foot-attachment lacing 46 is securely fastened by knotting or by lace lock 48. Lace locks, also known as cord locks, are a widely known and commonly available item from camping equipment suppliers. Lace grommets 50 are set in foot-attachment member 40 to reinforce member 40 against wear and abrasion of the lacing 46. A pivot rivet 60 (indicated in FIG. 3) passes through a rivet hole 58 in the foot-attachment member 40 and a fin pivot hole 22, 22' formed in fin extension arms 24, 24', respectively, (see FIG. 6) to attach fin assembly 20 to foot-attachment member 40 as a complete unit. This fastening allows the fin assembly 20 to hinge or pivot from either the extended or retracted position to the opposite position. A fin extension arm stop 52 is formed integral with foot-attachment 40 to retain fin assembly 20 in its forwardmost extended position. In this stopped position, movement of the fin to the rear against the resistance of the water generates a thrust propelling the float tube in a forward direction. On movement of the user's leg to the front, the fin assembly 20 is retained in the extended position by latch dogs 26 which are securely held in the extended position detents 54 by the latch springs 28. The detents 56 are formed in foot-attachment member 40 to interact with latch dogs 26 and latch springs 28 to retain the fin assembly 20 in its retracted position. The sides of the latch dog 26 and detents 54, 56 slope at an angle so that pressure from the opposite foot or pressure against the earth at the bottom of a body of water can overcome the resistance of latch springs 28 allowing the fin assembly 20 to be pivoted to the other position. FIGS. 8D and 8E show cross-sectional details of the fin extension arm stops 52, the extended position detents 54 and the retracted position detents 56.

In operation of this embodiment of the present invention, the complete hinged foot fin assembly, with fin assembly 20 in the retracted position, is secured to the user's foot by the foot-attachment member 40. On entering water of sufficient depth that the user is supported by the float tube seat, the user pivots the fin assembly 20 downward from the retracted position with his or her hand or opposite foot, disengaging the fin assembly 20 from its retracted position detents 56. With the fin assembly 20 in a partly extended position the user moves his or her leg to the rear in a full striding movement, completing rotation of fin assembly 20 to the fully extended position by pressure of the water against fin assembly 20. Alternatively, rotation to the fully extended position can be completed by continued pressure on the assembly 20 from the opposite foot. In its fully extended position, the fin is located below the user's foot as a leveraged extension of the user's leg, thereby increasing overall efficiency.

The propulsion vane frame 36, the propulsion vanes 30 and the propulsion vane hinges 32 are designed so that the vanes 30 feather, creating minimal drag when the user's leg is moved toward the front. The propulsion vanes 30 fully dose when the user's leg is moved toward the rear, creating maximum resistance to movement against the water and a resultant forward thrust. In this manner, the propulsion vanes 30 function to cause the fin assembly 20 to have a directionally differential resistance to movement through the water as a means of propelling a float tube forward in the water by movement of the user's legs in a forward and backward striding motion.

Efficiency of the fin assembly 20 is high, since it creates only a minimal drag on the forward or reset movement of the leg, but creates a maximum resistance on movement of the leg to the rear. Movement of the legs to provide forward thrust is similar to a normal walking stride with which users are familiar. The resultant forward propulsion is in the direction in which the user wishes to travel. Movement requires less effort that that required using prior art fins that propel the float tube backward from a swimmer's "flutter kick", or from prior art forward propelling fins.

On preparing to leave the water (while seated in the float tube), the user preferably releases the fin assembly 20 from the extended position detents 54 by pressing the fin against the earth at the bottom of the body of water, or by pressure from the opposite foot. Rotation to the retracted position is then completed using the opposite foot and/or the user's hands. When both fins have been secured in the retracted position, the user can then walk from the water in a normal manner, unrestricted by the fins.

As can be seen, the hinged fin embodiment of this invention is an efficient device for propelling a float tube in a forward direction in the water. Walking in marginal water and on land is unrestricted by the retracted fin, reducing the danger of stumbling and falling. While the foregoing description contains many specifications, these should not be construed as limitations on the scope of the invention, but rather as an exemplification of one preferred embodiment thereof. Many other variations, substitutions and modifications are possible. For example, other means of attaching the fin assembly to the user's foot could include wading boots or footgear (as normally used with neoprene waders), to which a pivotal means of attaching the fin assembly is permanently or removably affixed, replacing the foot-attachment means that is illustrated and described above. Other flow controlling means can replace the propulsion vanes illustrated and described, and/or the propulsion vanes can be oriented in a different plane than illustrated, that is they crux be horizontal rather than vertical. The fin size and configuration can also be altered. For example, in a handicapped version of the invention, the fin can be made larger and/or scooped to be more usable by persons having mobility of only one leg.

Figure 9:
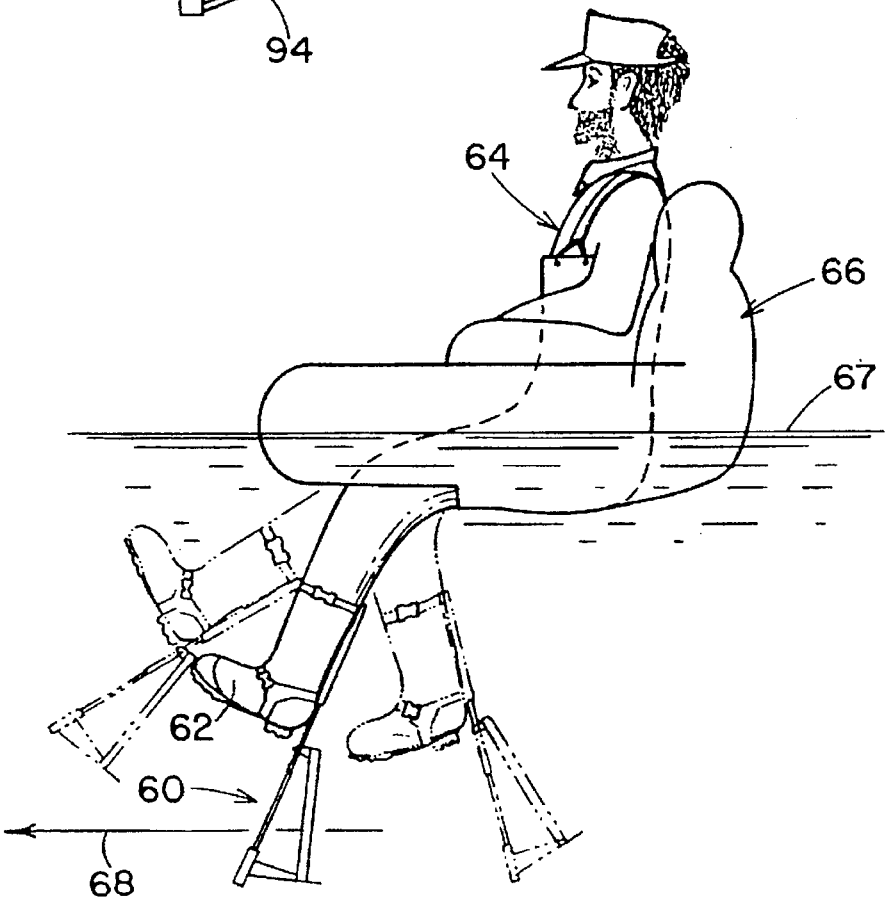
FIG. 9 is a side schematic illustrating a second embodiment of the present invention in position on the foot of a user while in a float tube and in an extended operable position.

Referring now to FIGS. 9–22, a second embodiment of the retractable fin assembly invention is illustrated. Referring first to FIG. 9, the fin assembly 60 is illustrated in its extended operable position secured to the boot 62 of a user 64 positioned within a float tube 66. The fin assembly 60 is designed to propel the user 64 and float tube 66 forwardly across the water's surface 67 in the direction illustrated by the arrow 68. In this manner, the user 64 is moved in the direction which he faces thus enhancing safety as well as providing a significant advantage to the user 64 when fishing or the like.

The fin assembly 60 of the present invention is constructed primarily of molded semi-rigid plastic material, although other strong, lightweight and corrosion resistant materials such as aluminum can be utilized integral with plastic materials, or as a substitute for the plastic material of some parts of the assembly 60. In addition, it should be understood that in the drawings, only the left fin or a sub-assembly of one fin is described, and it should be understood that there are paired left and right fins and sub-assemblies which arc constructed and operate in identical fashion.

In this particular embodiment, the fin assembly 60 is connected to the boot 62 of the user 64 in a vertical sliding manner as opposed to a hinged connection as illustrated in the prior embodiment. As will be seen, this particular construction permits easier movement back and forth between the retracted and operational positions of the fin assembly 60 when the user 64 is seated in the tube 66.

Referring with particularity to FIGS. 9–15, the fin assembly 60 includes a fin member 70 which is secured for sliding vertical movement to a support structure 72 which is in turn attached to the boot 62 by a boot attachment mechanism 74. The fin member 70 is substantially identical in construction to the fin assembly 20 of the prior embodiment and includes a plurality of propulsion vanes 30 secured for hinged pivotal movement to a frame 36 and operates between an open position and a closed position as previously described. In this instance, the frame 36 is constructed in a manner similar to that previously described.

Figure 11:
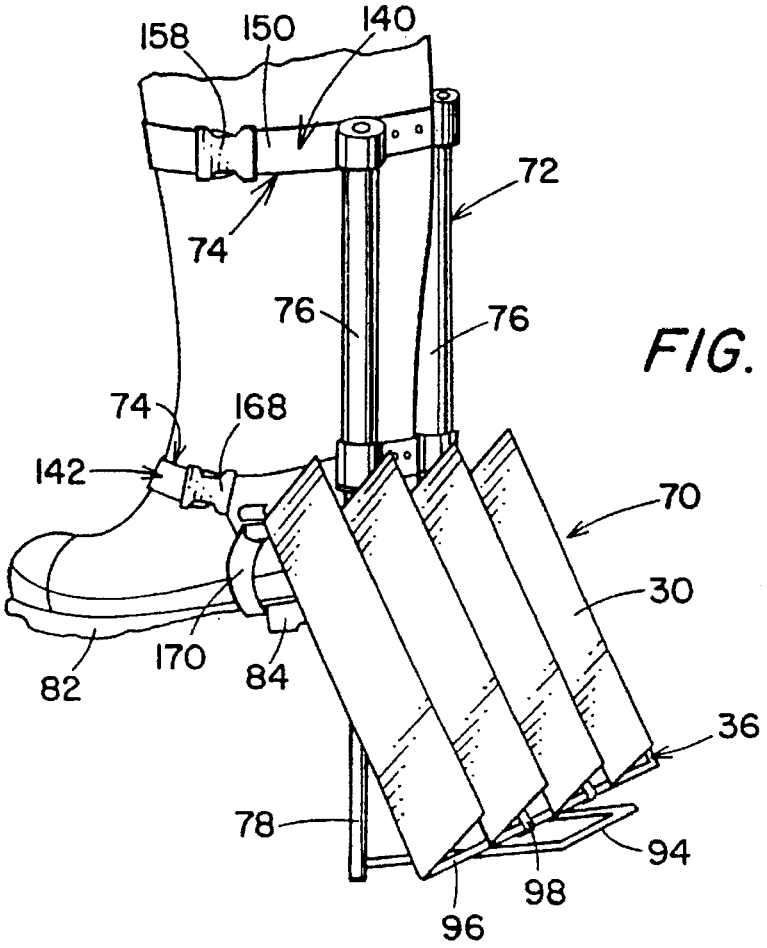
FIG. 11 is a side perspective illustrating the second embodiment of the present invention on the boot of a user in a partially extended operational position with the vanes thereof at an obtuse angle.
Figure 12:
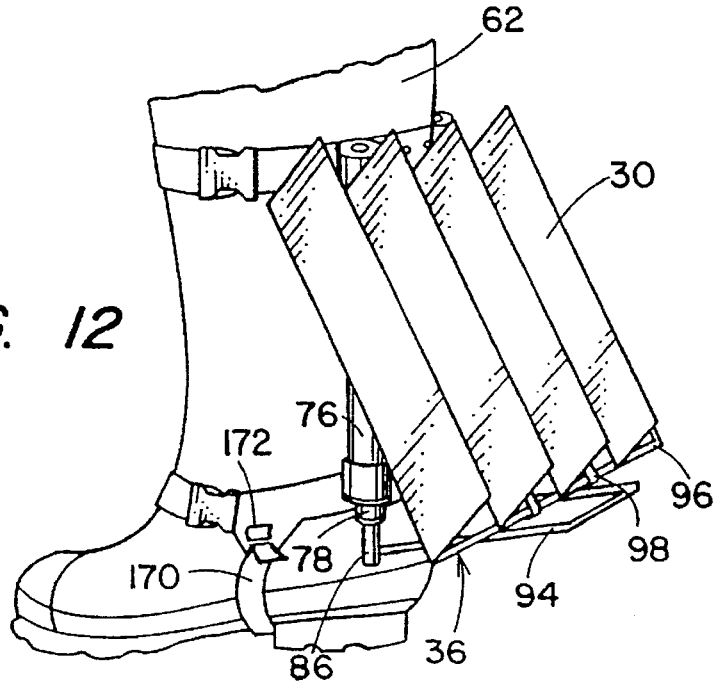
FIG. 12 is a side perspective similar to that of FIG. 11 but illustrating the fin assembly of the present invention in a retracted position.
Figure 13:
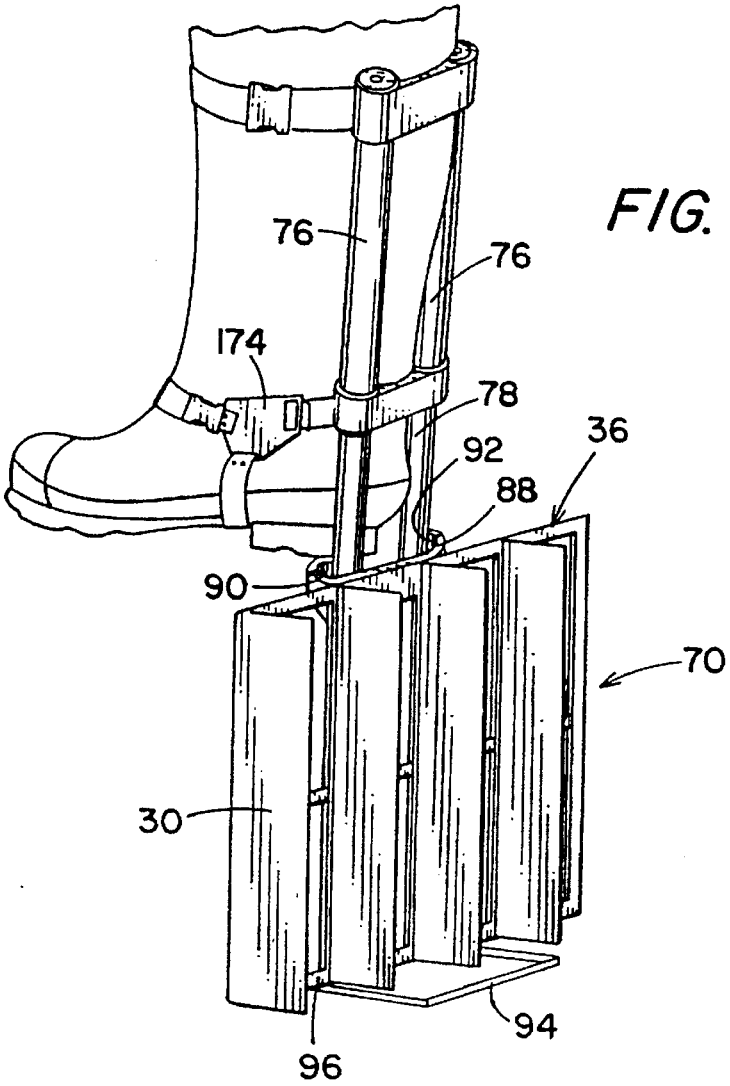
FIG. 13 is a side perspective similar to that of FIG. 11 with the fin assembly in an operational position with the vanes at a 90° angle.
Figure 14:
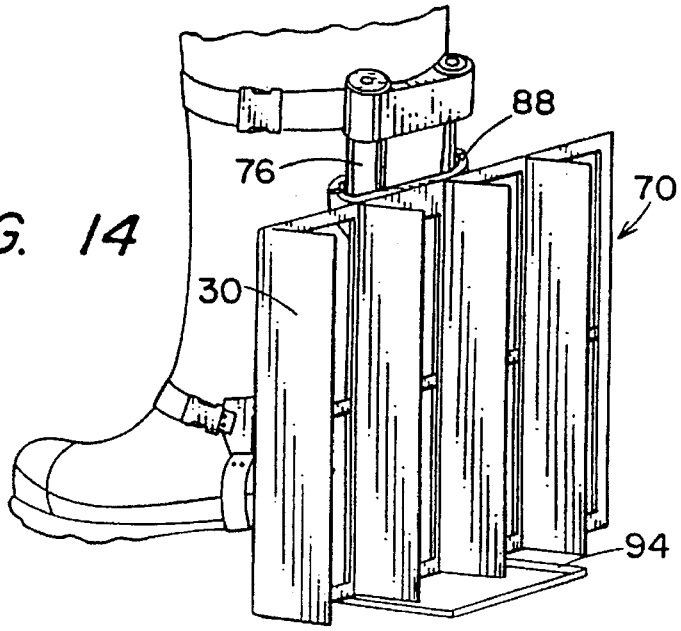
FIG. 14 is a side perspective similar to that of FIG. 13 but illustrating the fin assembly of the present invention in a partially retracted position.

The frame 36 and vanes 30 are secured to the boot attachment mechanism 74 by the support structure 72. In the preferred embodiment, the support structure 72 includes a pair of first support members 76 which are preferably in the form of spaced apart and substantially parallel robes. A second pair of support members 78 are interconnected for sliding movement to the support members 76 in a substantially vertical direction relative to the horizontal plane 80 which is defined by the heel 84 and sole 82 of the boot 62. In preferred form, the second support members 78 are in the form of spaced tubular members that are telescopically interconnected for longitudinal movement within the outermost first tubes 76. In this manner, the outermost robes 76 are securely connected to the boot attachment mechanism 74, and the inner tubes 78 are then connected for vertical telescoping movement into and out of the tubes 76 so as to move the fin member 70 in a vertical direction between a fully or partially retracted position as illustrated in FIGS. 12 and 14 and an operational position as illustrated in FIGS. 9–11, 13 and 15–16. In an alternate embodiment of this structure, a third smaller diameter pair of tubes 86 are positioned for telescoping movement within the robes 78 so as to have a three-tube system consisting of tubes 76, 78 and 86 all interengaged for telescoping movement together. However, it should be understood that two, three or even more tubular structures may be utilized to achieve the vertical telescopic movement of the present invention.

In preferred form, the uppermost portion of the frame 36 is secured to a follower 88. The frame 36 is preferably secured to the follower 88 in a hinged manner to allow the lower portion of the frame 36 to move between a first position immediately against the innermost tubular members 78 so as to lay in substantially the same plane as the support structure 72 (see FIGS. 13–15) or to move outwardly away from the tubes 78 as illustrated in FIGS. 9–12 and 16 for reasons described in greater detail below. The follower 88 is sized and shaped to surround both paired tubular members 78 and 76 so as to be capable of sliding movement therealong. In, addition, one form of providing hinged movement of the follower 88 is to size the follower 88 sufficiently to allow it to wobble about the tubes 76, 78 to create a hinged effect. To achieve this end, a pair of channels 90 and 92 are provided for surrounding the spaced tubes 78 and 76. The channels 90, 92 are sized sufficiently to not only slidingly engage and move along the tube 76 and 78 but also be capable of passing over the connection members of the boot attachment mechanism 74 to be described below.

Figure 15:
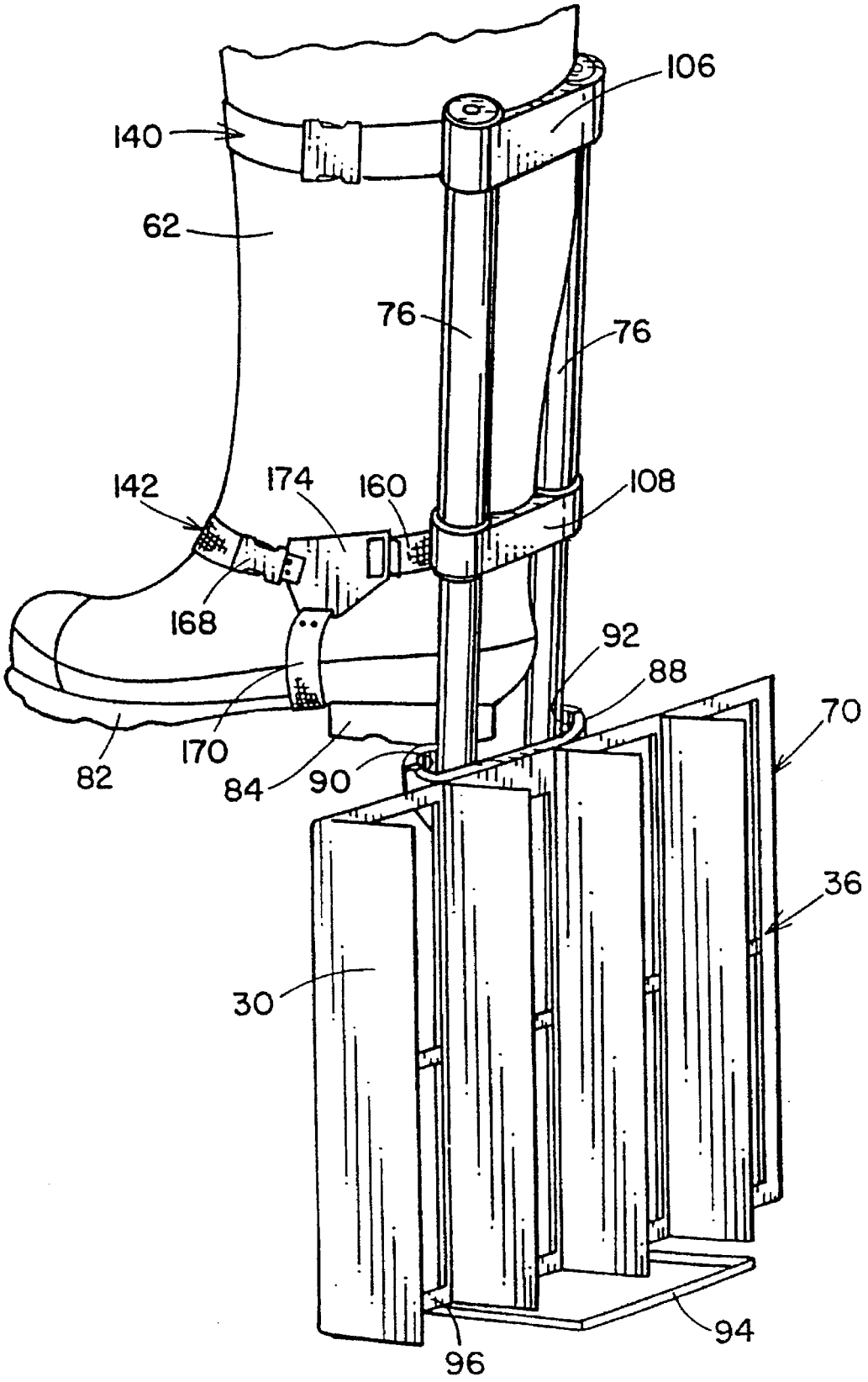
FIG. 15 is an enlarged side perspective similar to that of FIG. 14 but illustrating an alternate embodiment of a boot assembly connection member and showing the assembly in a fully extended position.
Figure 16:
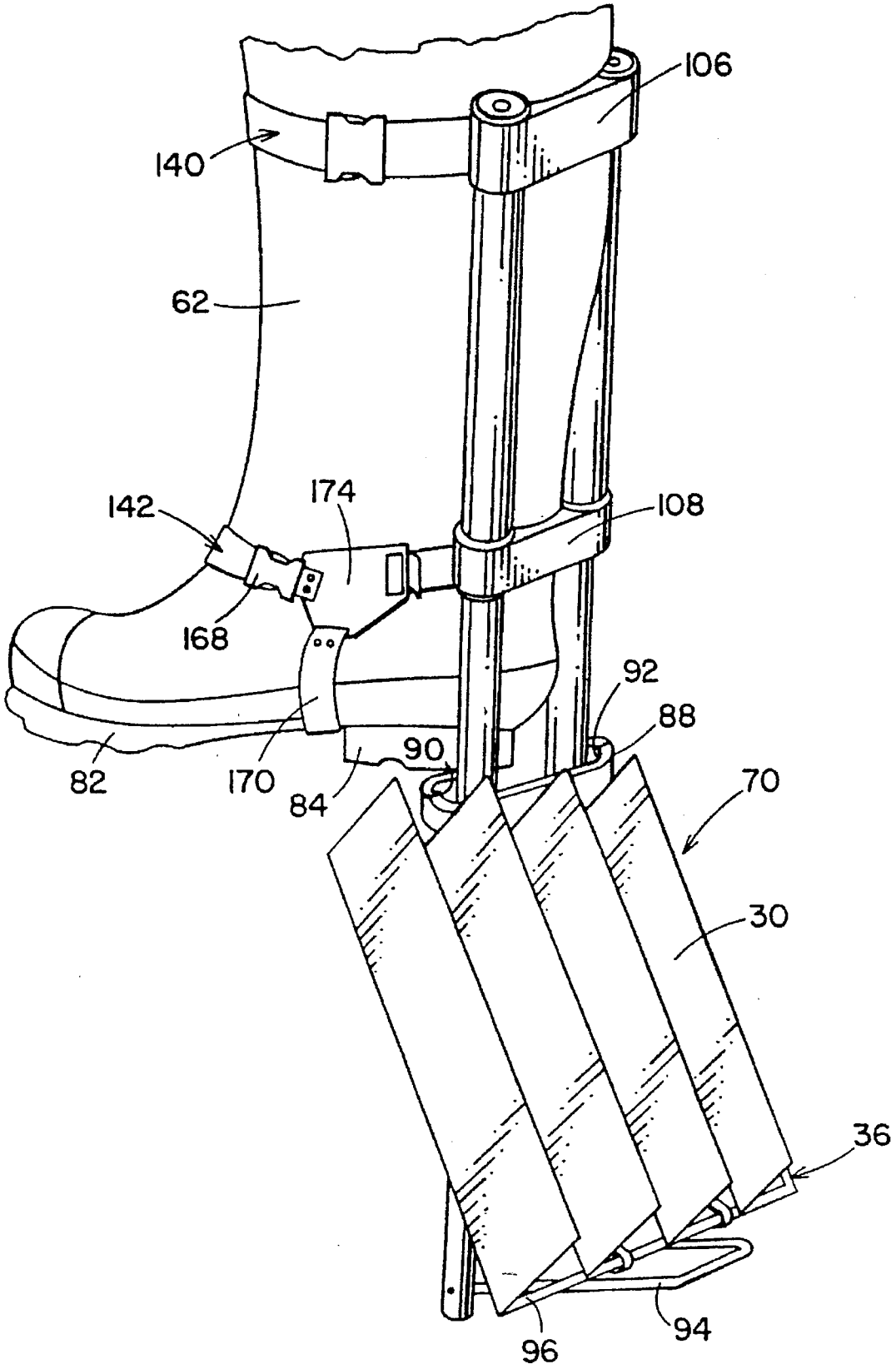
FIG. 16 is a side perspective similar to that illustrated in FIG. 11 but illustrating the alternate embodiment of the boot connection member with the assembly in a fully extended position.

As described in the prior embodiment of FIGS. 1–8, the fin assembly 60 of this embodiment is also preferably angled relative to the vertical plane as defined by the support structure 72. In preferred from, the frame 36 and vanes 30 can be aligned substantially vertical in alignment with the support structure 72 as illustrated in FIGS. 13–15, or they can be angled outwardly from the lowermost portion of the second tubular members 78 as illustrated in FIGS. 9–12 and 16. To accomplish this as well as to provide a ledge for the vertical movement of the frame 36, a U-shaped bracket 94 is secured to the lowermost ends of the innermost tubes 78 or 86, as the case may be. This would include the innermost tube 86 in the embodiment illustrated in FIG. 10 where there am three telescoping members 76, 78 and 86. Regardless of the number of telescoping members, the bracket 94 is connected to the lowermost end of the innermost telescoping member. The bottom rod 96 of the frame 36 is designed to rest firmly against the bracket 94. When the frame 36 is in its first position as illustrated by FIGS. 13–15, the angle Y which is formed between the frame 36 and the horizontal plane 80 is generally approximately 90°. In this instance, the frame 36 rests snugly against the intersection of the bracket 94 and the lowermost tubular members 78. This is true whether the fin assembly 60 is in its lower operational position as illustrated in FIGS. 13 and 15, in its partially retracted position as illustrated in FIG. 14, or in its fully retracted position for surface walking. As discussed with the prior embodiment, it is generally highly desirable to angle the frame 36 and vanes 30 outwardly and rearwardly away from the boot 62 so as to provide an optimum angle of attack which creates optimum efficiency and use of energy by the user 64. To accomplish this optimum positioning of the fin assembly 60, the frame 36 is preferably connected at the follower 88 to provide hinged pivotal like movement in accordance with any known standard manner so as to move the lowermost end or the rod 96 away from the tubular members 78 to provide an angle Y of up to approximately 125°. Depending on the construction as discussed below, several angular orientations may be accomplished between the range of 90°–125°. This angle Y of 125° may be maintained by the frame 36 and vanes 30 regardless of whether the fin assembly 60 is in its operational position as illustrated in FIGS. 9–12 and 16, in an intermediate position for use in shallow water as illustrated in FIG. 11, or in its retracted position for walking as illustrated in FIG. 12. A preferred manner of retracting fin assembly 60 is to push upwardly against the bracket 94 and/or rod 96 with the toe of the boot 62 of the opposite foot.

Figure 17:
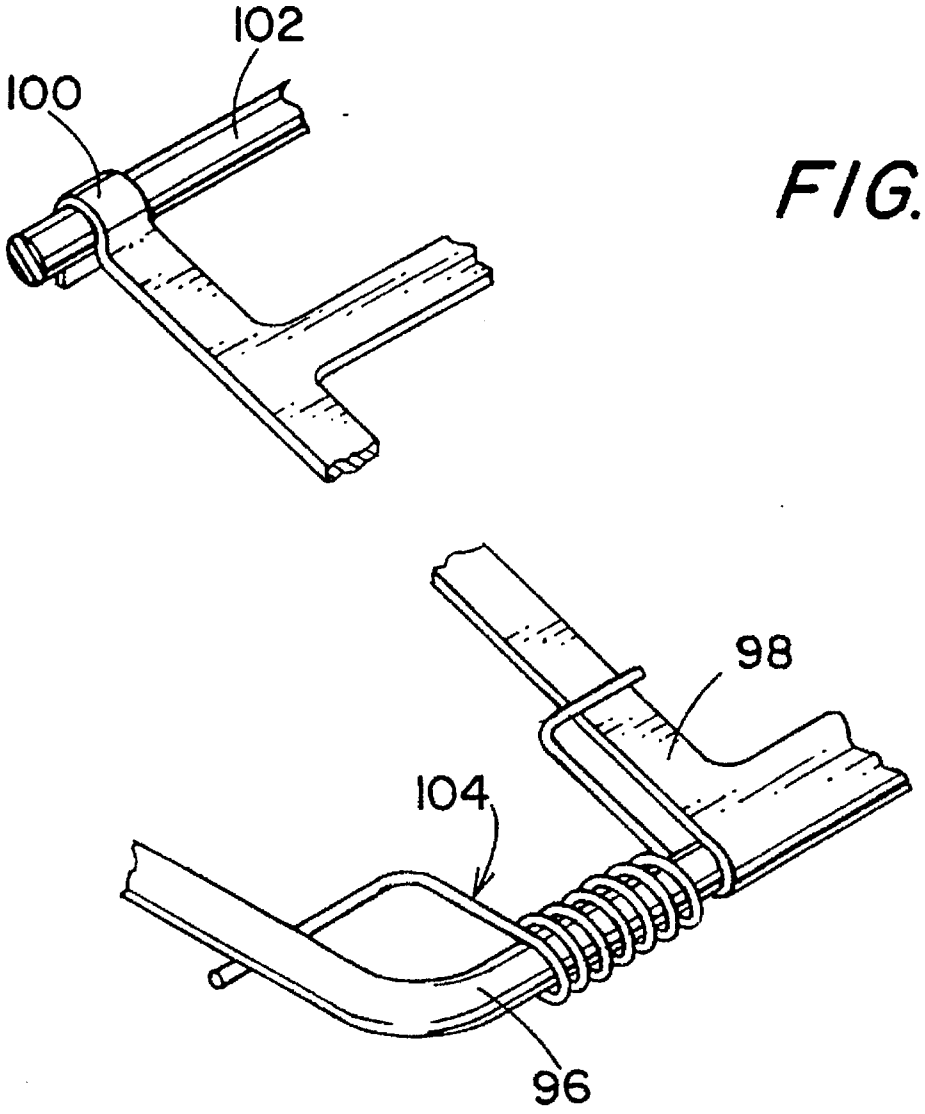
FIG. 17 is an enlarged, partially broken away schematic illustrating the clamp assembly for maintaining the angle of the fin assembly of the present invention.

Referring to FIG. 17, to accomplish secure attachment of the frame 36 in the angular position illustrated in FIGS. 9–12 and 16, a damp element 98 is pivotally mounted about the rod 96. The distal or free end 100 of the clamp element 98 is in the form of a hook end for engagement about a brace 102 which is interconnected between the paired lowermost tubular members 78 or 86, depending upon the embodiment selected. These can be particularly seen in FIGS. 10, 17 and 18. In preferred form, a spring mechanism 104 interengages the clamp element 98 so as to provide a downward force on the hook end 100 to firmly interconnect the hook end 100 with the brace 102. It should be understood that a plurality of braces 102 may be provided between the paired lowermost tubular members 78 so as to provide various different positions for engagement with the hook 100 and thereby provide several different angular orientations of the frame 36 relative to the vertical plane defined by the support structure 72. When it is desired to orient the frame 36 in a 90° position, the hook end 100 is disengaged from the brace 102, and the clamp element 98 is pivoted upwardly so as to bring the lowermost portion of the frame 36 inwardly to engage the junction between the bracket 94 and the tubular members 78. On the other hand, when it is desired to move the frame 36 to its greatest angular orientation, which is preferably 125°, the lowermost frame 36 is slidingly moved along the bracket 94 until the hook 100 engages the lowermost brace 102 disposed between the tubular members 78. In this manner, the frame 36 is then firmly secured in its angular position and will not disengage despite water flow through the vanes 30 or against the vanes 30 in their closed position, due to the spring tension provided by the spring mechanism 104 against the clamp dement 98.

As previously indicated, the support structure 72 is secured to the boot attachment mechanism 74. In preferred form and referring particularly to FIGS. 18–22, the support structure 72 includes an upper connection arm 106 and a lower connection arm 108. The arm 106 has a pair of cylinders 110 on either end thereof while the arm 108 likewise has a pair of cylinders 112 on either end thereof. In general, the connection arms 106, 108 are substantially similar in size and form, and the cylinders 110, 112 are preferably sized and shaped to snugly interengage the outermost tubes 76. In preferred form, a pair of bushings 114, are disposed at the uppermost openings of the cylinders 110 and the uppermost ends of tubes 76. The bushings 114 include pins 116 for engagement with apertures 121 in the tubes 76, thereby providing firm interengagement between the bushings 114, the outermost tubes 76 and the connection arm 106. Likewise, a pair of bushings 120 are provided at the lowermost openings of the cylinders 112 and include pin 122 for engagement with apertures 123 in the tubes 76 and so as to firmly interengage the bushings 120 with the outermost tubes 76 and the connection arm 108. The lowermost bushings 120 and the uppermost bushings 129 provide snug interengagement between the outermost tubular member 76 and the telescoping member 78 disposed therewithin. Apertures 118 and 124 are provided in the connection arms 106 and 108, respectively, to provide access to release the pins 116, 122 respectively, from the tubes 76 to facilitate disassembly for cleaning and the like.

In addition and in preferred form, a pair of tabs 111 are disposed opposite each other and project inwardly into the cylinders 110 and are sized and shaped to engage paired notches 113 in the upper ends of the tubes 76. Likewise, paired tabs 117 are provided in the cylinders 112 and are sized and shaped to engage the paired notches 119 provided in the lower ends of the tubes 76. In this manner, the tabs 111 and 117 engage the notches 113, 119, respectively, to maintain the paired tubes 76 in a substantially parallel relationship by preventing rotational movement of the tubes 76 within the cylinders 110, 112 of the connection arms 106 and 108. This engagement of the tabs 111, 117 with the notches 113, 119, respectively, further function to provide longitudinal stability to prevent the connection arms 106 and 108 from sliding inwardly toward each other along the length of the tubes 76. Thus, a rigid connection between the paired bushings 114 and 120, the connection arms 106 and 108, and the outermost tubes 76 results in a stable assembly of the support structure 72 which resists movement in all directions, such as wind, warp and rotational movement.

Figure 10:
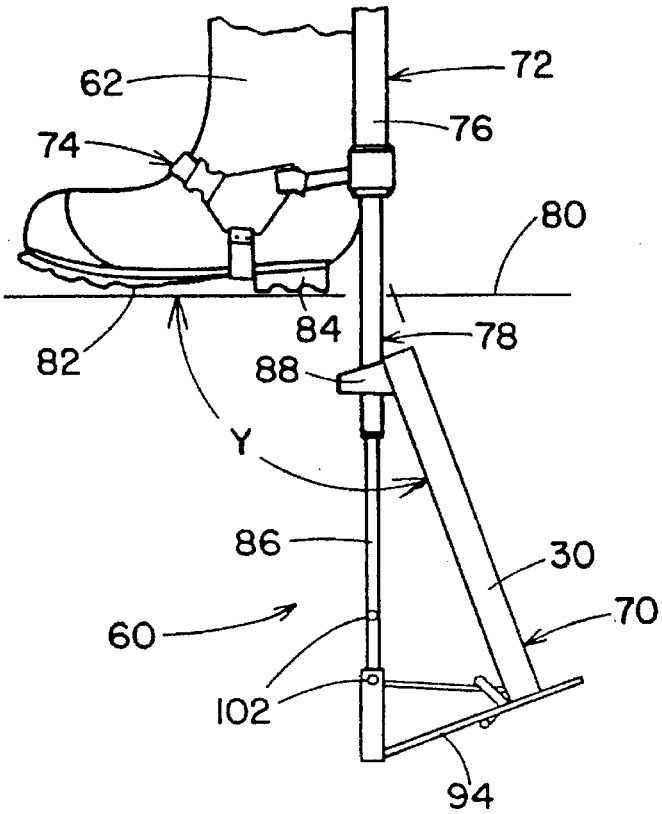
FIG. 10 is an enlarged side schematic illustrating the positioning of the second embodiment of the present invention in its operational position as shown in FIG. 9.
Figure 18:
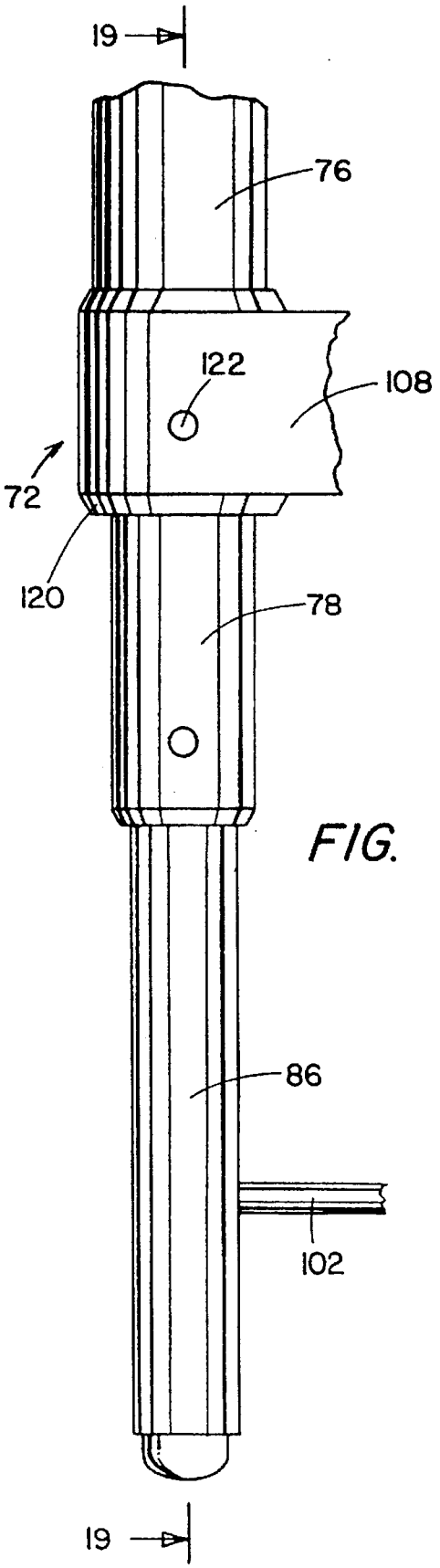
FIG. 18 is an enlarged, partial schematic of one tubular member for the support structure of the present invention.
Figure 19:
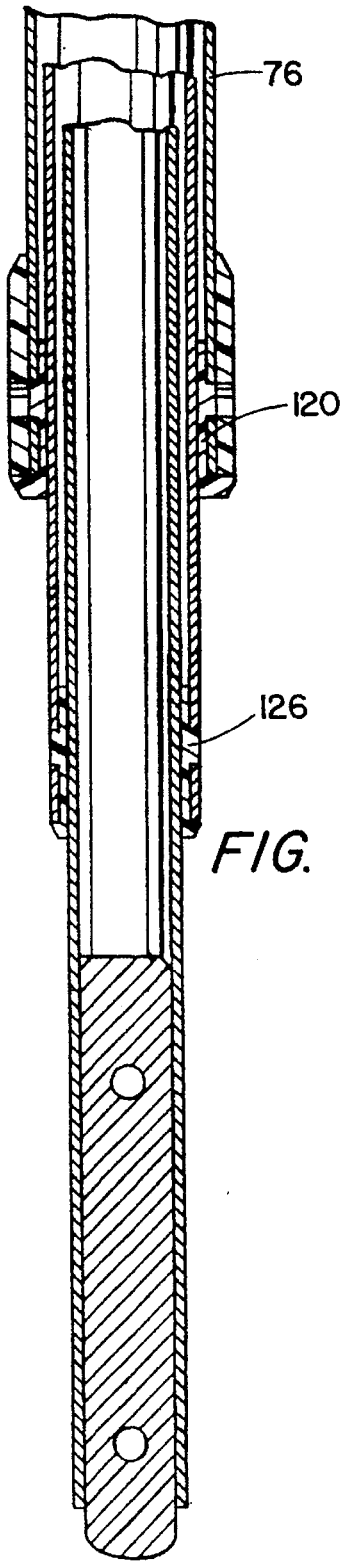
FIG. 19 is a cross-section taken substantially along line 19—19 of FIG. 18.
Figure 20:
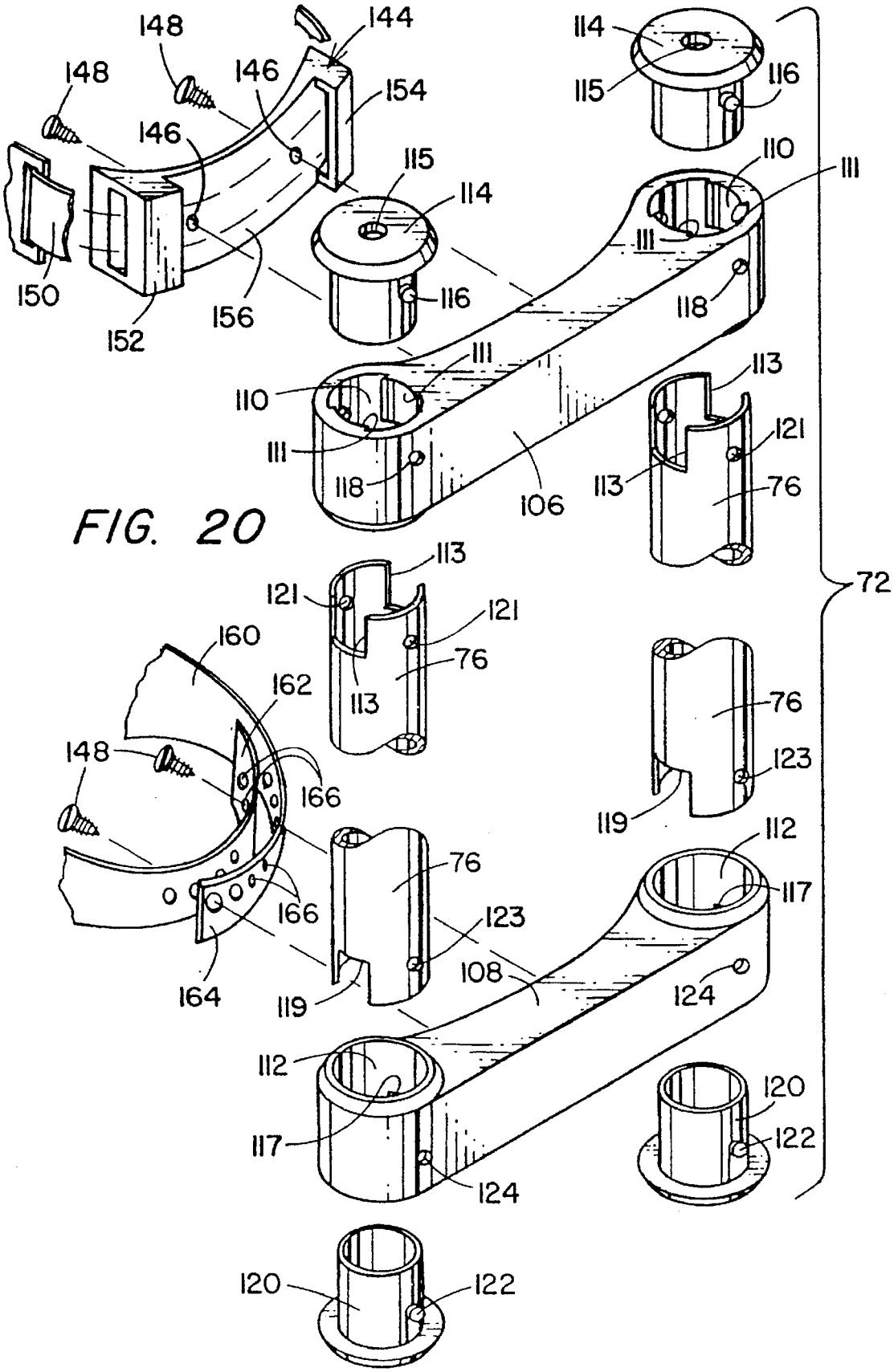
FIG. 20 is an enlarged, exploded schematic, with some parts broken away, of the interconnection of the support structure and the releasable attachment member of the present invention.

In the embodiment illustrated in FIGS. 10 and 18–19, a third telescoping member 86 is interengaged with the telescoping member 78 which likewise includes a bushing 126 at the lowermost end of the tube 78 to snugly interengage the tubular member 86 within the tubular member 78. The bushings 114, 120 and 126 are sized and shaped so as to provide snug fitting between the telescoping members 76, 78 and 86, and it is this snug fit that enables the telescoping members to be firmly locked into their position in either the retracted position or in their operational position. It should be understood, however, that other means of locking the telescoping tubular members in relative position to each other and thus locking the fin assembly 60 in its operating or retracted position may be utilized with the present invention such as spring loaded pin and aperture interlocking members and the like. Moreover, vent apertures 115 are provided at the ends of the bushings 114 and vent apertures 131 are provided in the tubes 78 and 86 to allow passage of air and/or water when the volume displacements in and between the telescoping tubes 76, 78 and 86 change as the tubes are extended or retracted.

Figure 21:
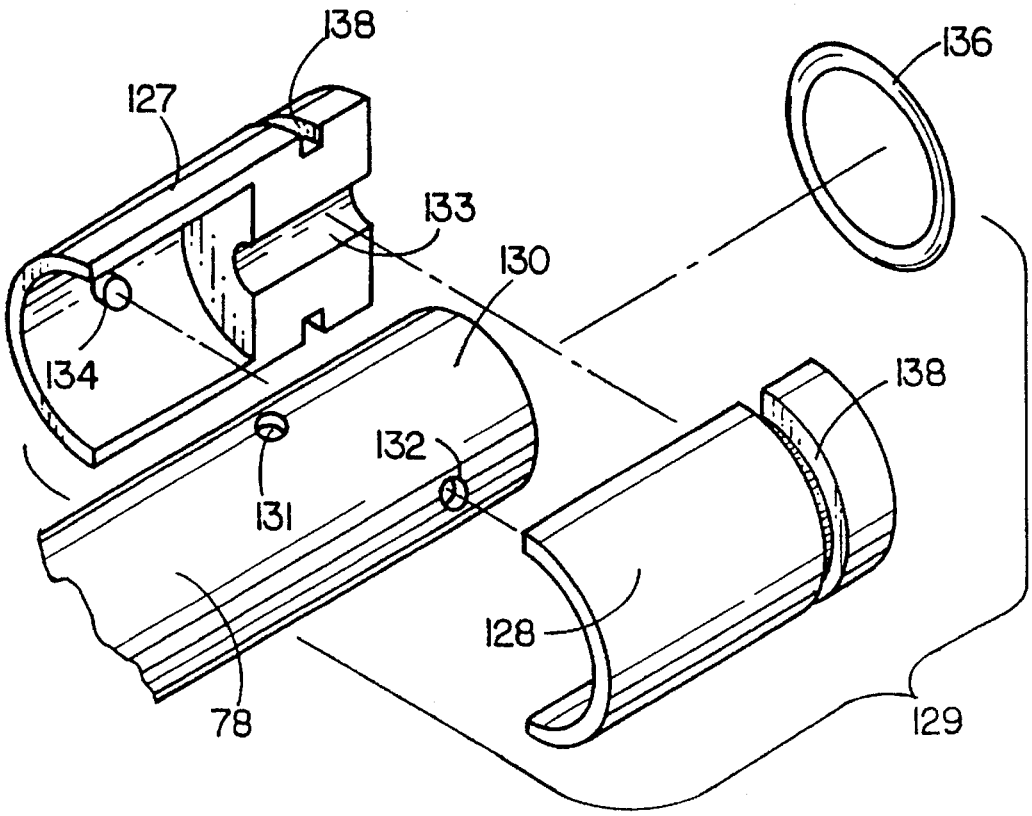
FIG. 21 is an enlarged, exploded schematic, with some parts in section, of an upper bushing assembly useful between telescoping tubes in the present invention as the releasable latching mechanism.
Figure 22:
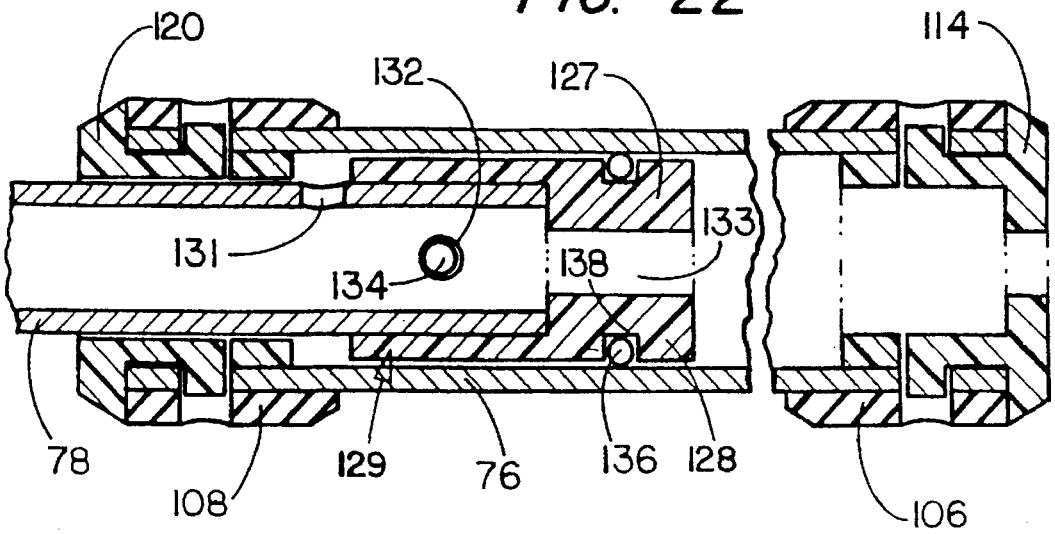
FIG. 22 is a partial cross-sectional view illustrating the bushing assembly of FIG. 21 in position between telescoping tubes.

FIGS. 21 and 22 illustrate the upper bushing 129 between the telescoping members 76 and 78, and the telescoping members 78 and 86 wherein split bushing members 127 and 128 are interengaged with the uppermost end 130 of the tubular members 78 and 86. In this instance, the tubular members 78 and 86 would have a pair of apertures 132 which are interengaged with interior pin members 134 of the bushing halves 127, 128. The pins 134 and apertures 132 would be sized and shaped for snug interengagement. Moreover, an optional O-ring 136 is preferably sized for engagement within a channel 138 so as to firmly interconnect the bushing halves 127, 128 and to provide additional friction to retain the tubes 78 and 86 in either a retracted, partially extended or fully extended position. Vent openings 133 in the upper bushings 129 and vent openings 131 in members 78 and 86 are provided for passage of air and/or water. In addition, each of the tubes 78 and 86 is retained in its fully extended position within the tube that surrounds it by contact of the uppermost surface of the lowermost bushings 120, 126, respectively, with the lowermost surface of the upper bushings 129. In their fully retracted positions, the tubes 78 and 86 are retained within outermost tube 76 by the bushings 114.

Referring now with particularity to FIGS. 11–16 and 20, the boot attachment mechanism 74 in one preferred form includes an upper connecting member 140 and a lower connecting member 142. The upper connecting member 140 preferably includes a connecting bracket 144 which is sized and shaped for interconnection with the connection arm 106. The connecting bracket 144 includes a pair of apertures 146, and attachment members such as screws 148 are interengaged through the apertures 146 of the bracket 144 and are securely fastened to the connection arm 106. A strap 150 passes through a pair of slide brackets 152, 154 on either end of the bracket 144 so as to firmly engage the outer surface 156 of the bracket 144. Straps 150 include apertures (not illustrated) to enable passage of the screws 148 therethrough. In preferred form, the strap 150 is sized so as to be capable of surrounding the upper boot area 62 and includes a latching mechanism 158 at each end thereof so as to snugly secure the strap 150 about the upper portion of the boot 62. It should be understood that the latching mechanism 158 is of typical standard design and is adjustable to accommodate different size boots 62. In a preferred embodiment, the latching mechanism 158 is a molded side release buckle commonly available from camping and outdoor recreation equipment suppliers.

The lower connecting member 142 includes a first strap 160 that has its terminal ends 162 and 164 overlapping. A plurality of apertures 166 are provided along the terminal ends 162, 164, and attachment members 148, such as screws, pass through the apertures 166 and interconnect the terminal ends 162 and 164 with the connection arm 108. The strap 160 likewise includes a latch mechanism 168 at its opposite ends similar to the mechanism 158 for securely fastening the ends of the strap 160 in an adjustable manner. In addition, a strap 170 is adjustably engageable with the strap 160 and is sized and shaped to pass under the sole 82 immediately in front of the heel 84 of the boot 62. The strap 170 is adjustably connected at 172 to the strap 160. In an alternate embodiment illustrated in FIGS. 13–16, the straps 160 and 170 are interconnected by a plate 174 so as to have a three-way union at a single point as opposed to the prior embodiment wherein the ends of the strap 160 interconnect and then the strap 170 is in turn connected to a broadened area of the strap 160. In either instance, both of these embodiments of the boot attachment mechanism 74 permit adjustable connection of the upper and lower connection arms 106, 108 of the support structure 72 firmly to the boot 62 and lower leg of the user 64. It should be noted that the follower 88 is sized to clearly pass over the connection arms 106, 108 so as to freely move along the support structure 72.

In operation, the fin assembly 60 is secured to the boot 62 of both feet of a user 64 in its retracted position, and then the user 64 steps into the center of the float tube 66 as previously described. Inasmuch as the fin assembly 60 is secured closely against the lower leg of the user 64, it does not interfere with ease of entry or exit of the float tube 66. Once the user 64 has walked into the water a sufficient depth so that the float tube 64 is floating on the water surface 67, the user 64 can then readily reach down through the opening of the tube 66 and push down on the upper edge of the frame 36 to move the fin 70 into its operational position. The angle of the frame 36 is adjusted by the clamp element 98 preferably before the user 64 enters the float tube 66. A user 64 then simply kicks his or her legs in a manner illustrated in FIG. 9 to move the fin assembly 60 in a back and forth motion to propel the user 64 and float tube 66 in a forwardly direction as with the prior embodiment. An alternate way of extending the fin assembly 60 to its operational position is by placing the toe of the opposite boot 62 on the end of the bracket 94 or follower 88 and simply pushing it down to extend the lower tubes 78 to their full extension thereby positioning the fin assembly 60 in its operational position as well as to pivot the fin member 70 to its predetermined angle. The reverse of this process may be utilized to retract the fin assembly 60. In addition, in shallow water, the user 64 can press on the very bottom end of the lowermost tube 78 or 86 to push the lowermost tubes and telescope them into the upper tubes 76 by downward foot pressure. Thus, whatever process the user 64 uses, the fin assembly 60 may be readily moved between its retracted and its operational positions with ease and safety.

As can be seen from the above, the present invention provides an enhanced fin assembly 60 for enabling the user of a float tube 66 to propel himself or herself in a forwardly direction. The present invention permits the float tube user 64 to very easily attach the fin assembly 60 to whatever type of boots 62 or existing footwear the user 64 chooses and to then readily position the fin assembly 60 in a retracted position to enable the user 64 to walk over dry surfaces or in shallow water. Moreover, the present invention allows easy movement of the fin assembly 60 from its retracted position to its operational position and then back again without difficulty or awkward moves by the user 64 in a float tube assembly, which awkward moves can increase the danger of tipping in such a float tube. The arrangement of the present invention is also lightweight thereby providing less cumbersome maneuvering with the fin assembly 60 in position and is relatively inexpensive due to its simplicity of construction. The angle of attack of the fin assembly may also be varied according to the desires or needs of the float tube user. In addition, the fin member 70 may be used at any partially extended or intermediate position for use in shallow water. Finally, the position of the vanes 30 in the fully retracted position still permits the user to utilize the device and create forward movement in very shallow water.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A retractable fin assembly for attachment to a boot of a float tube user, the boot having a heel and sole, said assembly comprising:

a fin member slidingly moveable between a first position wherein said fin member is adapted to project below the boot for propelling the float tube user forwardly in the water and a second position wherein said fin member is adapted for retraction relative to the heel of the boot to permit walking on land by the float tube user;

propulsion vane means carried by said fin member and having a closed position for providing substantial resistance to the flow of water as said fin member is moved in a rearward direction relative to the user, and an open position for providing substantially reduced resistance to the flow of water as said fin member is moved in a forward direction relative to the user; and means for attaching said fin member to the boot of the user such that said first position aligns the plane of said propulsion vane means at a pre-selected angle of 90° or greater between said fin member propulsion vane means and the boot sole as said propulsion vane means project downwardly from and behind the heel of the boot, and said second position aligns said fin member behind the boot heel and ankle of the user above the sole of the boot.

2. The assembly as claimed in claim 1, wherein said assembly further includes means for releasably maintaining said fin member in each of said first and second positions.

3. The assembly as claimed in claim 1, wherein said propulsion vane means comprises a frame having upper and lower portions and a plurality of elongated flaps hingedly secured to said frame substantially parallel to each other.

4. The assembly as claimed in claim 3, wherein said fin member attachment means includes a releasable attachment member mountable to the boot and a support structure for securing said fin member to said releasable attachment member for sliding substantially vertical movement relative to the sole of the boot between said first and second positions, said support structure including means for mounting said propulsion vane means frame.

5. The assembly as claimed in claim 4, wherein said frame mounting means is adapted to align said frame with said hinged elongated flaps at a pre-selected angle between about 90° wherein said frame is substantially vertical relative to the sole of the boot, and an obtuse angle of up to approximately 125° relative to the sole of the boot wherein said frame is angled downwardly and away from the toe of the boot.

6. The assembly as claimed in claim 5, wherein said frame mounting means includes means for hingedly securing the upper portion of said frame to said support structure, and a clamp clement for securing the lower portion of said frame to said support structure between a first frame position immediately adjacent said support structure to provide said 90° angle and a second frame position spaced outwardly and away from said support structure to provide said obtuse angle of up to approximately 125°.

7. The assembly as claimed in claim 6, wherein said clamp element is hingedly secured at one end to the lower portion of said frame and is releasably attachable at its other end to one of a plurality of vertically spaced braces disposed along said support structure.

8. The assembly as claimed in claim 4, wherein said support structure comprises a pair of substantially vertically aligned tubular members each comprising at least a pair of telescoping elements having radially innermost and outermost elements with the outermost tubular element secured to said releasable attachment member and the innermost tubular element secured for vertical telescoping movement within said outermost element and attached to said frame mounting means.

9. The assembly as claimed in claim 3, wherein said flaps are attached to said frame to move from said closed position wherein said flaps lie in substantially the same plane to form a surface to resist water flow, to said open position wherein said flaps are oriented up to approximately 90° to project outwardly from said plane in substantially parallel fashion to reduce resistance to water flow between the flaps.

10. The assembly as claimed in claim 9, wherein said frame further includes stop members to maintain said flaps in said closed position as water pressure increases against the surface of said flaps.

11. The assembly as claimed in claim 10, wherein said flaps are normally positioned intermediate said closed and said open positions and are moved to each said closed and open position in response to water flow against said flaps.

12. The assembly as claimed in claim 11, wherein said flaps are hingedly secured to said frame to move to said closed position in response to rearward movement of the leg of a user causing movement in a rearward direction of said fin member, and also to move to said open position in response to forward movement of the leg of a user causing movement in a forward direction of a fin member.

13. The assembly as claimed in claim 1, wherein said preselected angle between said fin member propulsion vane means and the sole of the boot is approximately 90°–125°.

14. A fin assembly for attachment to a boot of a float tube user, the boot having a toe and a heel, and adapted for selective sliding movement between an operating position for propelling the float tube user in a forwardly facing direction and a retracted position for enabling the float tube user to walk on land, said fin assembly comprising:

a fin member movable between said operating position and said retracted position and including vane means having a dosed position for providing substantial resistance to the flow of water in a first direction and an open position for providing minimal resistance to the flow of water in a second, opposite direction;

means for attaching said fin member to the boot of a user to orient said fin member in its operating position such that said vane means are in said dosed position as said fin member is moved by the leg movement of the user in a rearward direction relative to the float tube user to propel the float tube user in a forwardly facing direction;

means for slidingly moving said fin member in a substantially vertical direction relative to the boot of a user between said operating position and said retracted position; and means for releasably maintaining said fin member in said retracted position rearwardly of the boot of a user proximate the lower leg of the user and for releasably maintaining said fin member in the operating position projecting below the boot at a pre-selected angle of approximately 90° or more away from the toe of the boot.

15. The assembly as claimed in claim 14, wherein said fin member includes a frame having upper and lower portions defining a plane, and said vane means provides a plurality of elongated flaps hingedly secured to said frame substantially parallel to each other.

16. The assembly as claimed in claim 15, wherein said elongated flaps are attached to said frame to move from said closed position wherein said flaps lie in the plane of said frame to form a surface to resist water flow, to said open position wherein said flaps are oriented approximately 90° to the plane of said frame in substantially parallel fashion to substantially decrease resistance to water flow between said flaps.

17. The assembly as claimed in claim 16, wherein said flaps are normally positioned intermediate said closed and opened positions and are moved to each said closed and opened position in response to flow of water against said flaps in one of two opposite directions, said frame further including stop members to maintain said flaps in said closed position when water pressure is increased against the surface of said flaps

18. The assembly as claimed in claim 16, wherein said fin member attachment means includes a releasable attachment member mountable to the boot, and said slidingly vertical movement means includes a support structure for securing said fin member to said releasable attachment member for said vertical movement between said operating and retracted positions, said support structure further including a pair of substantially vertically aligned tubular members each comprising at least a pair of telescoping elements having innermost and outermost elements with the outermost elements secured to said releasable attachment member and the innermost elements secured for vertical telescoping movement within said outermost elements.

19. The assembly as claimed in claim 18, wherein said fin member frame is secured for substantially vertical movement with said innermost tubular element and is adapted to align the plane of said frame at said pre-selected angle between about 90° wherein the plane of said frame is substantially vertically aligned relative to the boot of a user and an obtuse angle of up to approximately 125° wherein the plane of said frame is angled downwardly and away from the toe of the boot of a user when said fin member is in its operating position.

20. The assembly as claimed in claim 19, wherein said support structure further comprises a slide member secured about said spaced tubular members for vertical movement therealong, and wherein said frame includes means for securing the upper portion of said frame to said slide member for vertical movement therewith as well as pivotal hinged movement, and a clamp element having a first end pivotally secured to the lower portion of said frame and a second free end selectively attachable to said support structure between a first position wherein the plane of said frame is substantially vertical with said frame being substantially proximate said support structure to provide said 90° angle and a second position wherein said lower frame portion is spaced outwardly and away from said support structure to provide said obtuse angle of up to approximately 125°.

21. The assembly as claimed in claim 20, wherein said support structure further includes a plurality of brace members interconnected between said paired tubular members, and wherein said clamp element includes means for releasably attaching the free end thereof to said brace members to vary the alignment of the plane of said frame between said 90° angle and said obtuse angle of up to approximately 125°.

22. A fin assembly for attachment to a boot of a float tube user, the boot having a toe and a heel, and adapted for selective movement between an operating position for propelling the float tube user in a forwardly facing direction and a retracted position for enabling the float tube user to walk on land, said fin assembly comprising:

boot attachment means for releasably securing said assembly to the boot of a user;

a fin member movable between said operating position aligned below and behind the heel of the boot of a user, and said retracted position aligned behind and upwardly from the heel of the boot immediately proximate the back of a user's lower leg;

means for telescopically attaching said fin member to said boot attachment means for sliding movement between said operating and said retracted positions;

vane means carried by said fin member and having a closed position for providing substantial resistance to the flow of water in a first direction and an open position for providing minimal resistance to the flow of water in a second, opposite direction when said fin member is in its operating position, said vane means being in a closed position as said fin member is moved by the leg movement of a user in a rearward direction relative to the float tube user to propel the float tube user in said forwardly facing direction;

means for releasably maintaining said fin member in its retracted position; and means for releasably maintaining said fin member in its operating position at a pre-selected angle relative to the boot of a user of approximately 90° to 125° away from the toe of the boot.

23. The assembly as claimed in claim 22, wherein said vane means comprise a frame defining a plane and a plurality of elongated flaps hingedly secured to said frame substantially parallel to each other, said flaps being aligned in said plane when said vane means is in a closed position and aligned substantially perpendicular to said frame plane when said vane means is in said open position, and wherein said telescoping attachment means comprises a pair of spaced tubular members aligned substantially vertically relative to the boot of a user and each including at least two tubular elements including innermost and outermost elements with the outermost element being secured to said boot attachment means and said innermost element being secured for vertical sliding movement within said outermost element and adapted for carrying said frame.

* * * * *